US008886548B2

(12) United States Patent
Ishikawa et al.

(10) Patent No.: US 8,886,548 B2
(45) Date of Patent: Nov. 11, 2014

(54) AUDIO ENCODING DEVICE, DECODING DEVICE, METHOD, CIRCUIT, AND PROGRAM

(75) Inventors: Tomokazu Ishikawa, Osaka (JP); Takeshi Norimatsu, Hyogo (JP); Kok Seng Chong, Singapore (SG); Huan Zhou, Singapore (SG); Haishan Zhong, Singapore (SG)

(73) Assignee: Panasonic Corporation, Osaka (JP)

( * ) Notice: Subject to any disclaimer, the term of this patent is extended or adjusted under 35 U.S.C. 154(b) by 716 days.

(21) Appl. No.: 13/141,169

(22) PCT Filed: Oct. 21, 2010

(86) PCT No.: PCT/JP2010/006234

§ 371 (c)(1),
(2), (4) Date: Jun. 21, 2011

(87) PCT Pub. No.: WO2011/048815

PCT Pub. Date: Apr. 28, 2011

(65) Prior Publication Data

US 2011/0268279 A1 Nov. 3, 2011

(30) Foreign Application Priority Data

Oct. 21, 2009 (JP) ..... 2009-242302

(51) Int. Cl.

| | |
|---|---|
| ***G10L 21/04*** | (2013.01) |
| ***G10L 19/008*** | (2013.01) |
| ***H04S 3/02*** | (2006.01) |
| ***G10L 19/26*** | (2013.01) |
| *G10L 19/09* | (2013.01) |
| *G10L 19/02* | (2013.01) |

(52) U.S. Cl.

CPC ..... *G10L 19/265* (2013.01); *G10L 19/09* (2013.01); *G10L 19/0212* (2013.01); *G10L 19/008* (2013.01)

USPC ..... 704/503; 704/500; 704/501; 381/22; 381/23

(58) Field of Classification Search

USPC ..... 381/17–18, 22–23; 704/200, 203, 503, 704/500–501

See application file for complete search history.

(56) References Cited

U.S. PATENT DOCUMENTS

| | | | |
|---|---|---|---|
| 6,226,606 | B1 | 5/2001 | Acero et al. |
| 6,300,553 | B2 | 10/2001 | Kumamoto et al. |

(Continued)

FOREIGN PATENT DOCUMENTS

| | | |
|---|---|---|
| CN | 101203907 | 6/2008 |
| CN | 101228573 | 7/2008 |

(Continued)

OTHER PUBLICATIONS

International Search Report issued Dec. 21, 2010 in corresponding International Application No. PCT/JP2010/006234.

(Continued)

*Primary Examiner* — Duc Nguyen
*Assistant Examiner* — George Monikang
(74) *Attorney, Agent, or Firm* — Wenderoth, Lind & Ponack, L.L.P.

(57) ABSTRACT

Provided is an encoding device (1) including: a pitch contour analysis unit (101) which detects information, a dynamic time-warping unit (102) which generates, based on the information, pitch change ratios (Tw_ratio in FIG. 18) within a range (86) including a range (86*a*) of the pitch change ratios corresponding to absolute pitch differences of 42 cents or larger; a first lossless coding unit (103) which codes the generated pitch parameters (102*x*); a time-warping unit (104) which shifts a pitch of a signal according to the information; and a second encoding unit which codes a signal (104*x*) obtained by the shifting.

17 Claims, 21 Drawing Sheets

(56) References Cited

U.S. PATENT DOCUMENTS

| | | | | |
|---|---|---|---|---|
| 6,963,646 | B2 | 11/2005 | Takagi et al. | |
| 7,490,035 | B2 | 2/2009 | Fujishima et al. | |
| 2001/0013270 | A1 | 8/2001 | Kumamoto et al. | |
| 2002/0064284 | A1 | 5/2002 | Takagi et al. | |
| 2003/0088173 | A1 | 5/2003 | Kassai et al. | |
| 2006/0222188 | A1 * | 10/2006 | Asakawa | 381/94.1 |
| 2007/0127585 | A1 * | 6/2007 | Suzuki et al. | 375/265 |
| 2007/0282602 | A1 | 12/2007 | Fujishima et al. | |
| 2008/0004869 | A1 | 1/2008 | Herre et al. | |
| 2010/0100390 | A1 | 4/2010 | Tanaka | |

FOREIGN PATENT DOCUMENTS

| | | | |
|---|---|---|---|
| CN | 101552005 | | 10/2009 |
| JP | 60-263375 | | 12/1985 |
| JP | 60-263377 | | 12/1985 |
| JP | 10-111694 | | 4/1998 |
| JP | 2001-188600 | | 7/2001 |
| JP | 2002-162996 | | 6/2002 |
| JP | 2002-268694 | | 9/2002 |
| JP | 2003-521721 | | 7/2003 |
| WO | 2006/046761 | | 5/2006 |
| WO | 2007/018815 | | 2/2007 |
| WO | WO2009038512 | * | 3/2009 |

OTHER PUBLICATIONS

Milan Jelinek et al., "Wideband Speech Coding Advances in VMR-WB Standard", IEEE Transactions on Audio, Speech, and Language Processing, vol. 15, No. 4, May 2007, pp. 1167-1179.

Xuejing Sun, "Pitch Determination and Voice Quality Analysis Using Subharmonic-to-Harmonic Ratio", IEEE, May 2002, pp. 333-336.

Bernd Edler et al., "A Time-Warped MDCT Approach to Speech Transform Coding", AES 126th Convention, Munich, Germany, May 2009, pp. 1-8.

* cited by examiner

Fig. 18

85(103t,201t)

| Cents | Bit sequence | Data of ratio between two pitches: Tw_ratio | Data of ratio between two pitches: Tw_ratio_index | Bits |
|---|---|---|---|---|
| 60 | 1111110 | 1.0416 | 12 | 7 |
| 50 | 111100 | 1.0293 | 11 | 6 |
| 40 | 1000 | 1.02285719 | 10 | 4 |
| 30 | 1100 | 1.01714289 | 9 | 4 |
| 20 | 1010 | 1.01142859 | 8 | 4 |
| 10 | 1110 | 1.0057143 | 7 | 4 |
| 0 | 0 | 1 | 6 | 1 |
| -10 | 1001 | 0.994285703 | 5 | 4 |
| -20 | 1101 | 0.988571405 | 4 | 4 |
| -30 | 1011 | 0.982857168 | 3 | 4 |
| -40 | 111110 | 0.9772 | 2 | 6 |
| -50 | 111101 | 0.9715 | 1 | 6 |
| -60 | 1111111 | 0.9604 | 0 | 7 |

88b (88)

90b (90)

88a (88,88x)

90a (90,90x)

86

861 (86a)

87

Wider range in present embodiment

Range in conventional technique 862 (86a)

AUDIO ENCODING DEVICE, DECODING DEVICE, METHOD, CIRCUIT, AND PROGRAM

TECHNICAL FIELD

The present invention relates generally to transform audio coding systems, and particularly to a transform audio coding system in which a time-warping techniques is used for shifting a pitch frequency of input audio signals to improve coding efficiency and sound quality. The audio coding system can be applied not only to coding of an audio signal but also to coding of a speech signal, and thus can be used in mobile phone communications or a teleconference through telephone or video.

BACKGROUND ART

Transform coding technology is designed to code audio signals efficiently. The fundamental frequency of the signal representing human speech varies sometimes. This causes the energy of a speech signal to spread out to wider frequency bands. It is not efficient to code a pitch-varying speech signal using a transform codec, especially in low bitrate. The time-warping technique is used in conventional techniques to compensate effects of variation of pitch as disclosed in NPL 3 [3] and PTL 1 [4], for example.

FIG. 10 illustrates an example of the idea of shifting the fundamental frequency.

The time-warping technique is used for the pitch shifting. In FIG. 10, (a) illustrates an original spectrum and (b) illustrates the spectrum after pitch shifting.

In (b) of FIG. 10, the fundamental frequency is shifted from 200 Hz to 100 Hz. By shifting the pitch of the next frame to align with the pitch of previous frame, the pitch is made consistent.

FIG. 11 illustrates the spectrum after pitch shifting.

The energy of the signal converges as shown in FIG. 11.

In FIG. 11, (a) illustrates a sweep signal and (b) illustrates the signal after pitch shifting. The pitch shown in (b) is constant.

In FIG. 11, (c) illustrates the spectrum of the signal shown in (a) and the spectrum of the signal shown in (b). As shown in (c) of FIG. 11, the energy of the signal (b) is confined to a narrow bandwidth.

The pitch shifting is achieved using a re-sampling method. In order to maintain a consistent pitch, the re-sampling rate varies according to the pitch change rate. For an input frame, a pitch contour of this frame is obtained by applying a pitch tracking algorithm.

FIG. 8 illustrates segmentation of one audio frame.

A frame is segmented into small sections for pitch tracking as shown in FIG. 8. The adjacent sections may overlap with each other. For example, in at least one combination of sections, (part of) one section of two adjacent sections may overlap with (part of) the other section.

Currently, there are pitch tracking algorithms based on auto-correlation disclosed in NPL [1], and pitch detection methods based on the frequency domain disclosed in NPL [2].

Each of the sections has a corresponding pitch value.

FIG. 15 illustrates calculation of a pitch contour.

In FIG. 15, (a) illustrates a signal with time-varying pitch. One pitch value is calculated from a section of the signal. A pitch contour is a concatenation of the pitch values.

During time warping, the re-sampling rate is in proportion to the pitch change rate.

Pitch change information is extracted from the pitch contour.

Cents and semitones are often used to measure the pitch change rate.

FIG. 12 shows the measurement of the cents and semitones. A cent is calculated from a pitch ratio between adjacent pitches:

$$\text{cent} = 1200 \times \log_2 \frac{\text{pitch}(i+1)}{\text{pitch}(i)}. \quad \text{[Eq. 1]}$$

Re-sampling is performed on a time domain signal according to the pitch change rate. Pitches of other sections are shifted to the reference pitch to be a consistent pitch. For example, when a pitch of a section is higher than a pitch of the previous pitch, the re-sampling rate is set to lower in proportion to the difference in cents between the two pitches. When a pitch of a section is not higher, the sampling rate needs to be higher.

With a recording player which allows audio playback speed adjustment, higher tone is shift to lower frequency by lowing down the playing speed. This is similar to the idea of re-sampling a signal in proportion to the pitch change rate.

FIG. 13 and FIG. 14 illustrate a coding system in which a time-warping scheme is integrated.

FIG. 13 is a block diagram of time warping in an encoder (an encoder 13A).

FIG. 14 is a block diagram of time warping in a decoder (a decoder 14A).

The time domain signal is warped before transform encoding. Pitch information is necessary for the decoder to perform reverse time warping. Therefore, pitch ratios need be encoded by the encoder.

In the conventional techniques, a small fixed table is used for coding the pitch ratio information. Small bits are used for coding the pitch ratios. However, such a small table has limitation, so that the performance of time warping deteriorates when the signal has a large pitch change rate.

On the other hand, a large table requires more bits, and bits left for transform coding is insufficient, and therefore sound quality also deteriorates. Currently, the effect of the time warping using a fixed table is limited. The above processes (such as coding) are, for example, the processes which are the same as the processes to be specified by the standards of the International Organization for Standardization (ISO), which will be described in detail below.

CITATION LIST

Non Patent Literature

[NPL 1] [1] Milan Jelinek, "Wideband Speech Coding Advances in VMR-WB Standard", IEEE Transactions on Audio, Speech and Language Processing, Vol. 15, No. 4 May 2007

[NPL 2] [2] Xuejing Sun, "Pitch Detection and Voice Quality Analysis Using Subharmonic-to-Harmonic Ratio", IEEE ICASSP, pp. 333-336, Orlando, 2002

[NPL 3] [3] Bernd Edler, "A Time-warped MDCT Approach To Speech Transform Coding", AES 126th Convention, Munich, Germany, May 2000

Patent Literature

[PTL1] [4] Juergen Herre, "Audio Encoder, Audio Decoder and Audio Processor Having a Dynamically Variable Warping Characteristic", Publication No. US 2008/0004869 A1

SUMMARY OF INVENTION

Technical Problem

The motivation of using time warping is to obtain consistent pitch within one frame and improve coding efficiency. Time warping relies on accuracy in pitch tracking to a certain extent.

However, there is a problem that the pitch contour detection may be difficult because of change in the amplitude and cycle of a signal. Although some post processing schemes, such as smoothing, fine tuning of threshold parameters, have been used in order to improve the pitch detection accuracy, these schemes are based on particular databases.

When time warping is applied based on an inaccurate pitch contour, the sound quality deteriorates and the bits used for sending the time-warping information are wasted. It is therefore necessary to design time warping which is not blindly based on a detected pitch contour.

Currently, there is no method of coding pitch contour information which can work efficiently in the time warping in the conventional techniques.

In the conventional techniques, a fixed table is used for representing a pitch contour.

A smaller table is not sufficient for the situation in which the pitch changes dramatically, while a larger table occupies more bits.

It is likely to be costly especially in low bitrate coding. It is a trade-off for improvement in the coding efficiency by using bits for sending time-warping parameters.

Therefore, with a more efficient method of coding time-warping parameters, saved bits can be used for transform coding and a signal with larger pitch changes can be supported, so that sound quality is improved.

A simple way to implement a time-warping scheme into a transform coding system is to concatenate the time-warping scheme directly with transform coding. In the conventional techniques, time-warping schemes are independent of transform coding. Since a target of the time warping is to improve transform coding efficiency, the time warping can benefit from using some coding information from a transform coding system. In view of this, the present invention has an object of improving current transform coding structures with a time-warping scheme.

The present invention has another object of providing an encoding device and a decoding device which use pitch change ratios (see a ratio 88 in FIG. 18) across an appropriate range (see a range 86). The present invention has another object of providing an encoding device which performs an appropriate process for pitch change ratios (see a ratio 88 in FIG. 18) across a wider range such that sound quality is improved. The present invention has another object of providing an encoding device which may decrease the amount (for example, an average amount) of data (see data 90L in FIG. 22) of codes (see codes 90 in FIG. 18) resulting from coding of a pitch (see a pitch 822 and a ratio 83 in FIG. 15 and ratios 88 in FIG. 18). The present invention has the other object of providing an encoding device which performs, in a comparatively appropriate manner, processes in accordance with standards such as the ISO standards to be specified in the future.

Solution to Problem

An encoding device according to an aspect of the present invention includes: a pitch detector which detects pitch contour information of an input audio signal; a pitch parameter generator which generates, based on the detected pitch contour information, pitch parameters that include pitch change ratios (Tw_ratio and Tw_ratio_index in FIG. 18) within a range (a range 86) including a range (a range 86*a*) of the pitch change ratios (Tw_ratio: 1.0416, 1.0293, 0.9772, 0.9715, and 0.9604) corresponding to absolute pitch differences of 42 cents or larger (Cents: 60, 50, −40, −50, −60); a first encoder which codes the generated pitch parameters; a pitch shifter which shifts pitch frequency of the input audio signal according to the pitch contour information; a second encoder which codes audio signal obtained by the shifting and output from the pitch shifter; and a multiplexer which combines the coded pitch parameters output from the first encoder and data of the audio signal output from the pitch shifter and then coded by and output from the second encoder, to generate a bitstream including the coded pitch parameter and the data.

Specifically, the pitch parameters (see the ratios 88 in FIG. 18) are coded by the first encoder of the encoding device. By the first encoder, a pitch parameter is coded into a coded pitch parameter having a relatively short code length (see a code 90*a*) when the pitch parameter is a pitch change ratio corresponding to a relatively small absolute pitch difference in cents (see Cents in FIG. 18) (see the ratio 88*a*), and a pitch parameter is coded into a coded pitch parameter having a relatively long code length (see a code 90*b*) when the pitch parameter is a pitch change ratio corresponding to a relatively large absolute pitch difference in cents (see the ratio 88*b*).

A decoding device according to an aspect of the present invention decodes a bitstream including coded data of a pitch-shifted audio signal and coded pitch parameter information, and includes: a demultiplexer which separates the coded data and the coded pitch parameter information from the bitstream to be decoded; a first decoder which generates, from the separated coded pitch parameters, decoded pitch parameters that include pitch change ratios (Tw_ratio and Tw_ratio_index in FIG. 18) within a range (a range 86) including a range (a range 86*a*) of the pitch change ratios (Tw_ratio: 1.0416, 1.0293, 0.9772, 0.9715, and 0.9604) corresponding to absolute pitch differences of 42 cents or larger (Cents: 60, 50, −40, −50, and −60); a pitch contour reconstructor which reconstructs pitch contour information according to the generated decoded pitch parameters; a second decoder which decodes the separated coded data to generate the pitch-shifted audio signal; and an audio signal reconstructor which transforms the pitch-shifted audio signal into an original audio signal according to the reconstructed pitch contour information.

Specifically, the separated coded pitch parameter information is decoded by the first decoder of the decoding device. By the first decoder, coded pitch parameter information having a relatively short code length is decoded into a pitch parameter which is a pitch change ratio corresponding to a relatively small absolute pitch difference in cents, and coded pitch parameter information having a relatively long code length is decoded into a pitch parameter which is a pitch change ratio corresponding to a relatively large absolute pitch difference in cents.

For example, a signal processing system may be also provided which includes an encoding device and a decoding device in the configuration as described below (see also the beginning part of the embodiments).

In the encoding device of the signal processing system, the pitch shifter generates a second signal from a first signal by shifting the pitch of the first signal to a predetermined pitch. Next, the second encoder codes the generated second signal into a third signal. Next, the pitch parameter generator calculates a pitch change ratio indicating the pitch of the first signal before the shifting. Then, the first encoder codes the calculated pitch change ratio into a code.

On the other hand, in the decoding device, the second decoder decodes, into the second signal, the third signal generated by coding the second signal generated from the first signal by shifting the pitch of the first signal to the predetermined pitch. Next, the audio signal reconstructor generates the first signal from the second signal obtained by the decoding of the third signal. Next, the first decoder decodes the code into the pitch change ratio. Then, the pitch contour reconstructor calculates the pitch which is indicated by the pitch change ratio obtained by the decoding of the code and used for the generation of the first signal having the pitch.

Here, when the code, which is generated by coding the pitch change ratio and to be decoded into the pitch change ratio, is generated by coding a first pitch change ratio corresponding to a relatively small pitch difference in comparison with a pitch change ratio corresponding to a pitch difference in cent of zero cent, the code is a first code having a relatively short code length. When the code is generated by coding a second pitch change ratio corresponding to a relatively large pitch difference, the code is a second code having a relatively long code length.

The third signal generated by coding the second signal generated by the shifting of the first signal, is generated by the encoding device and decoded by the decoding device only when a difference between the pitch change ratio of the pitch of the first signal before the shifting and the pitch change ratio of zero cent is equal to or smaller than a threshold, and not generated when the difference is larger than the threshold. The threshold is not a value for a musical interval smaller than 42 cents but a value for a musical interval equal to or larger than 42 cents.

As mentioned above in the Technical Problem, an inaccurate pitch contour may lead to deterioration of sound quality after time warping.

Hereinafter, a dynamic time-warping scheme to overcome the problem is proposed. It is a time-warping scheme which also takes a harmonic structure into account.

In time warping, harmonics are modified along with the pitch shifting, it is therefore necessary to take into account a harmonic structure during time warping.

In the proposed harmonic time-warping scheme, a pitch contour is modified base on analysis of a harmonic structure. The harmonic structure during time warping is thus taken into account, so that deterioration in sound quality is prevented.

In addition, in the proposed dynamic time-warping scheme, effectiveness of time warping is evaluated by comparing harmonic structures before and after the time warping, and a determination is made as to whether time warping should be applied to the current frame. It eliminates inaccuracy due to an inaccurate pitch contour.

In the conventional techniques, pitch contour information is sent to a decoder directly without any compression. In view of this, a more efficient method of coding time-warping parameters in dynamic time warping is proposed. By statistical analysis of a pitch contour for time warping, it is found that the time warping is only activated at a few positions where pitch changes in a frame of a signal.

It is therefore more efficient to code the information only at the positions where time warping has been applied to.

Furthermore, due to the uneven probability of occurrence of the pitch change values, bits are saved by using a lossless coding method to code time-warping parameters.

In the proposed dynamic time-warping scheme, information on positions where time warping is applied to and the time-warping values for the corresponding positions are used. Bits are saved by coding the whole pitch contour using a fixed table as described in the conventional techniques.

The proposed dynamic time-warping scheme also supports a wider range of time-warping values. The term "to support" means to operate in an appropriate way. The saved bits are used for transform coding, and use of such a wider range of time-warping values improves sound quality.

On the other hand, there are many transform coding systems which use a mid-side (M-S) stereo mode for coding stereo audio signals. In view of this, a new structure is proposed in which M-S mode information from the transform coding system is used in order to improve time-warping performance. When left and right channels have similar characteristics, it is more efficient to use the same time-warping parameters on left and right signals. When left and right channels are very different, applying the same time warping may decrease efficiency in coding. An M-S mode is therefore used for time warping in the proposed transform coding structure.

For example, the decoding device may use position information (data 102*m* in FIG. 9) specifying positions where pitch changes (for example, the position 704*p* in FIG. 9) among the positions in a frame (see the positions 841 to 84M in the frame 84 in FIG. 16) such that, in the bitstream received by the decoding device (see the bitstreams 106*x*, 205*i*, etc.), signals may be time-warped (or pitch-shifted) only at the positions where pitch changes by the audio signal reconstructor but not at the other positions (the position 704*q*).

Advantageous Effects of Invention

In the time-warping scheme according to the present invention, a pitch contour is modified based on information of analysis of a harmonic structure of an audio signal, and effectiveness of time warping is evaluated by comparing the harmonic structures before and after time warping in order to make a determination as to whether the time warping should be applied to the corresponding audio frame. This prevents deterioration of sound quality due to inaccuracy in the detected pitch contour information. Furthermore, the time-warping technique according to the present invention improves sound quality and coding efficiency of the audio coding system by utilizing M-S stereo mode information from the transform coding system.

In addition, a more appropriate range of a pitch change ratio (see the range 86 of the ratios 88 in FIG. 18) is used.

Then, an appropriate process is performed on the pitch change ratio in such a wider range (see the ratios 88 in FIG. 18) that sound quality is improved.

In addition, the data amount (for example, an average amount) of codes (see the codes 90 in FIG. 18) obtained by coding of a pitch (see the pitch 822 and the ratio 83 in FIG. 15 and the ratios 88 in FIG. 18) is reduced.

BRIEF DESCRIPTION OF DRAWINGS

FIG. 18 illustrates a table.

DESCRIPTION OF EMBODIMENTS

The following describes embodiments of the present invention with reference to the drawings.

Figure 11:
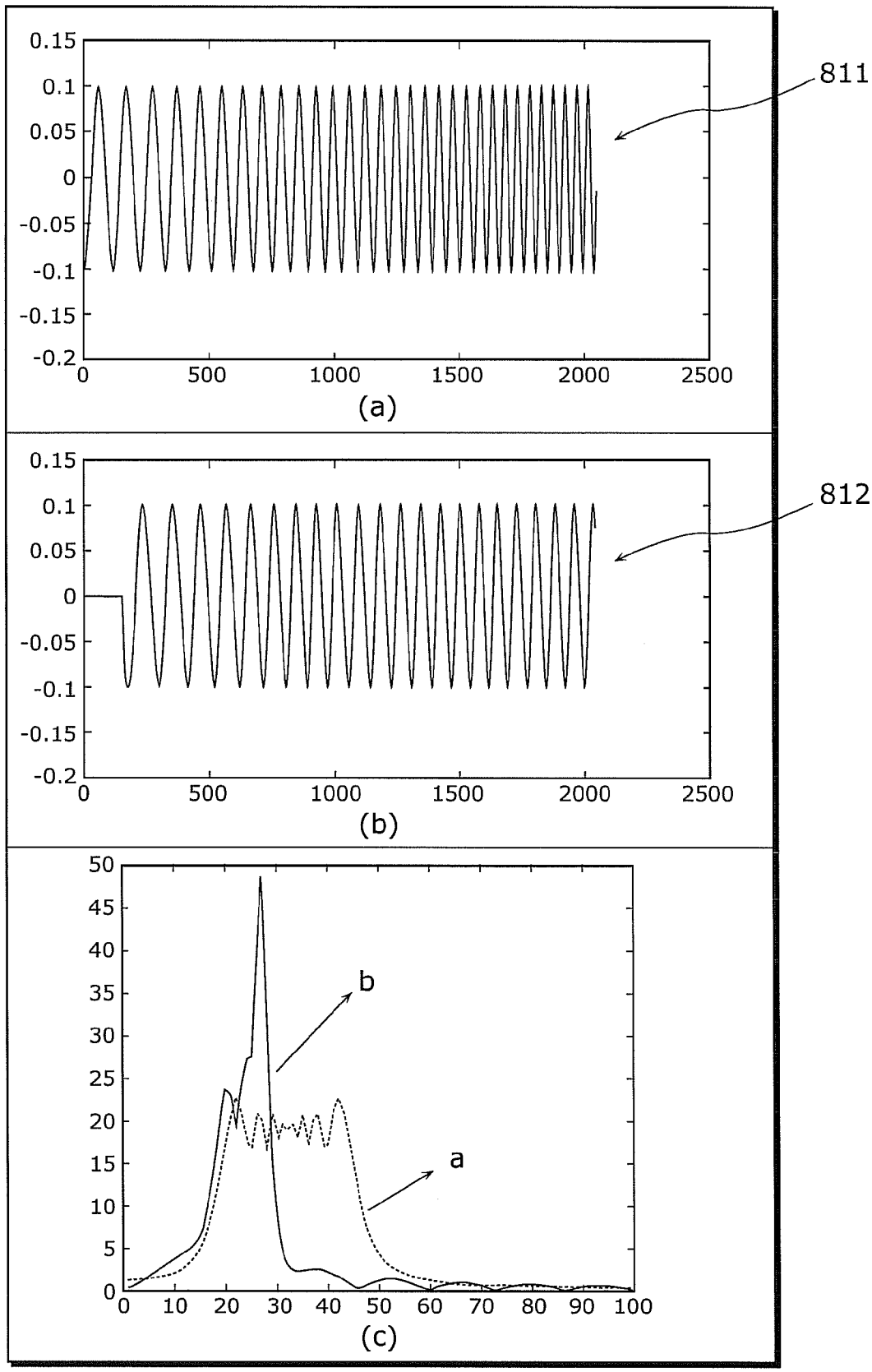
FIG. 11 illustrates a spectrum after pitch shifting.
Figure 15:
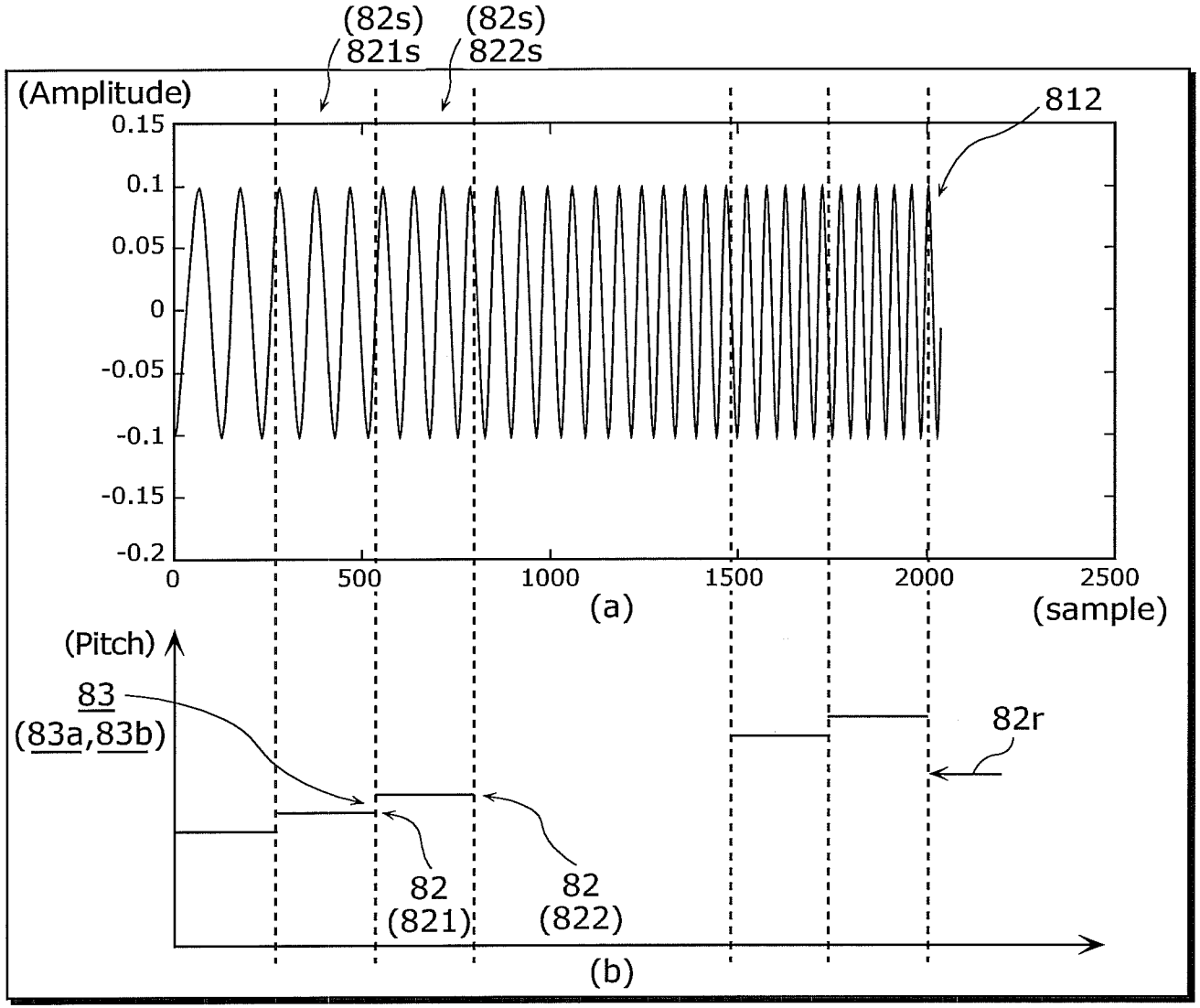
FIG. 15 illustrates calculation of a pitch contour.

An encoding device (an encoding device 1) included in a system (a system 2S in FIG. 20) according to the embodiments of the present invention includes: a pitch detector (a pitch contour analysis block (pitch contour analysis unit) 101) which detects pitch contour information (information 101*x*, which specifies, for example, a pitch 822 in FIG. 15) of an input audio signal (a signal 101*i* in FIG. 1, a signal 811 in FIG. 11); a pitch parameter generator (a dynamic time-warping block 102) which generates, based on the detected pitch contour information (the information 101*x*), pitch parameters (parameters (pitch change ratios) 102*x*, ratios 88 in FIG. 18) that include pitch change ratios (Tw_ratio in FIG. 18, the ratio 83 in FIG. 15, the ratios 88 in FIG. 18) within a range (a range 86 in FIG. 18) including a range (a range 86*a*) of the pitch change ratios (Tw_ratio in FIG. 18: 1.0416, 1.0293, 0.9772, 0.9715, and 0.9604) corresponding to absolute pitch differences of 42 cents or larger (Cents: 60, 50, −40, −50, and −60); a first encoder (a lossless coding unit 103) which codes the generated pitch parameters (the parameters 102*x*) (into codes 90 in FIG. 18); a pitch shifter (a time-warping block 104) which shifts pitch frequency (a pitch 822 in FIG. 15) of the input audio signal (a signal (a first signal) 101*i*) (into a reference pitch 82*r* in FIG. 15) according to the pitch contour information (the information (the pitch) 101*x*, the pitch 822); a second encoder (a transform encoder block 105) which codes audio signal (a second signal 104*x*) obtained by the shifting and output from the pitch shifter (into a third signal 105*x*); and a multiplexer (a multiplexer block (a multiplexer circuit) 106) which combines the coded pitch parameters (the parameters 103*x*, codes 90) output from the first encoder (the lossless coding block 103) and data (the third signal 105*x*) of the audio signal (the signal (second signal) 104*x*) output from the pitch shifter (the transform encoder block 105) and then coded by and output from the second encoder, to generate a bitstream (a stream 106*x*) including the coded pitch parameter and the data.

Figure 12:
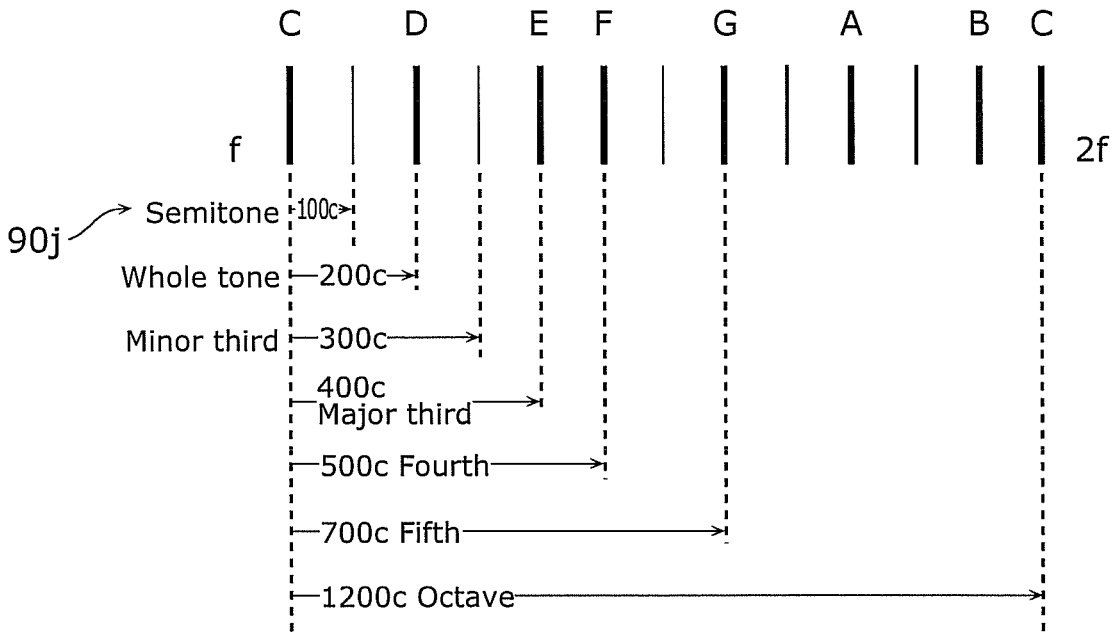
FIG. 12 illustrates cents and semitones.

A musical interval (for example, an interval between two pitches 821 and 822 in FIG. 15) of one cent is a hundredth of a musical interval of a semitone composed of 100 cents (for example, see 90*j* in FIG. 12). In other words, one cent is a musical interval of a twelve-hundredth of one octave.

It is to be noted that, for example, the generated pitch parameters may be composed of only pitch change ratios, or may include parameters other than pitch change ratios. Such pitch parameters part of which is pitch change ratios may be one of different types of generated pitch parameters.

Specifically, for example, in the encoding device (the encoding device 1), the first encoder (the lossless coding unit 103) codes each of the pitch parameters (the parameter 102*x* in FIG. 1, the ratios 88 in FIG. 18)) into a coded pitch parameter (the code 90*a*, for example, "0") having a relatively short code length (a length of 1 bit; see Bits in FIG. 18) when the pitch parameter (the ratio 88) is a pitch change ratio (a ratio 88*a*, for example, "1.0") corresponding to a relatively small absolute pitch difference (between two pitches (see pitches 821 and 822 in FIG. 15)) in cents (0; see Cents in FIG. 18), and codes each of the pitch parameters into a coded pitch parameter (the code 90*b*, for example "111100") having a relatively long code length (for "111100", a length of 6 bits) when the pitch parameter (the ratio 88) is a pitch change ratio (a ratio 88*b*, for example, "1.0293") corresponding to a relatively large absolute pitch difference in cents (50).

Figure 1:
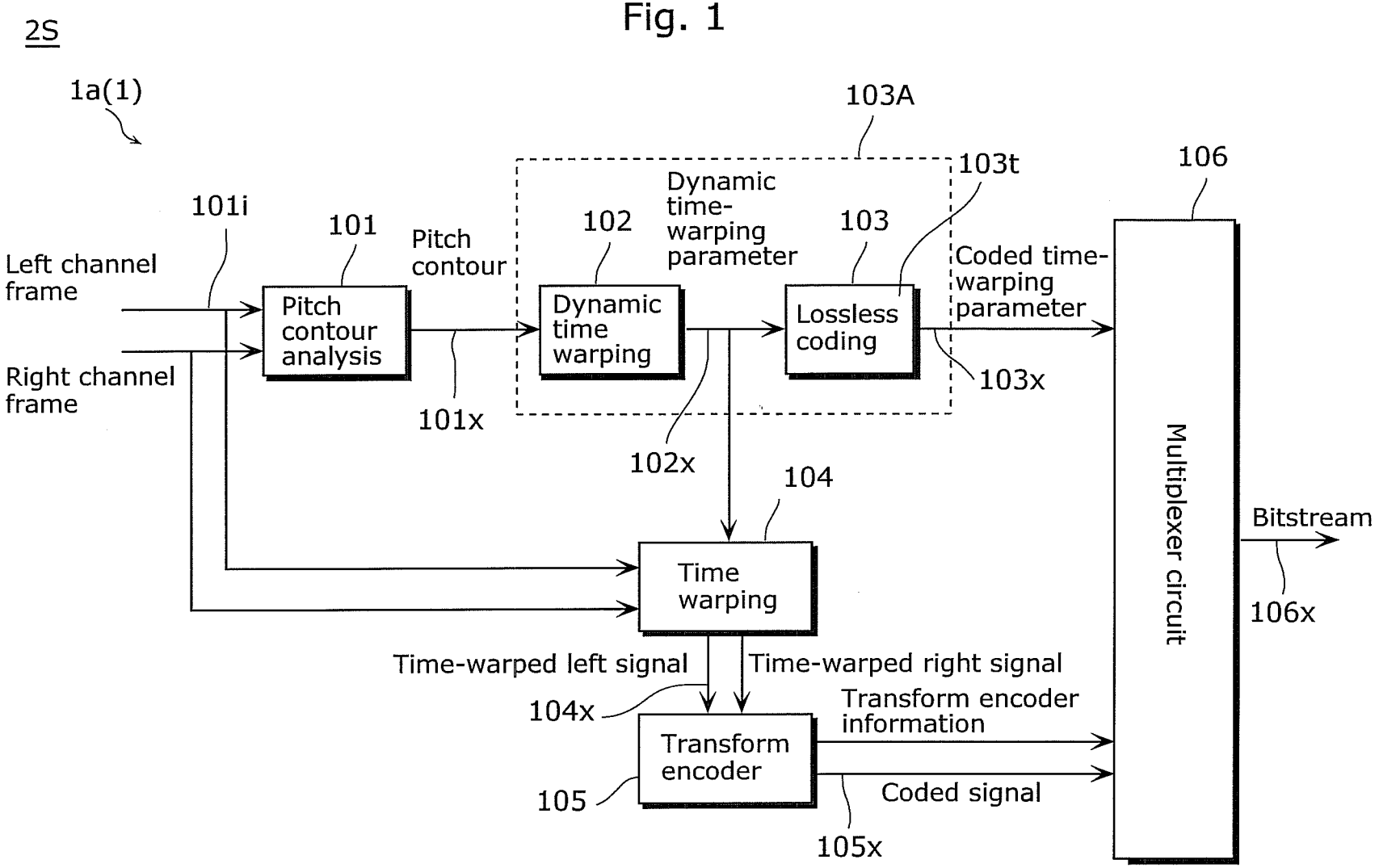
FIG. 1 is a block diagram of an encoder in which dynamic time warping is performed.
Figure 2:
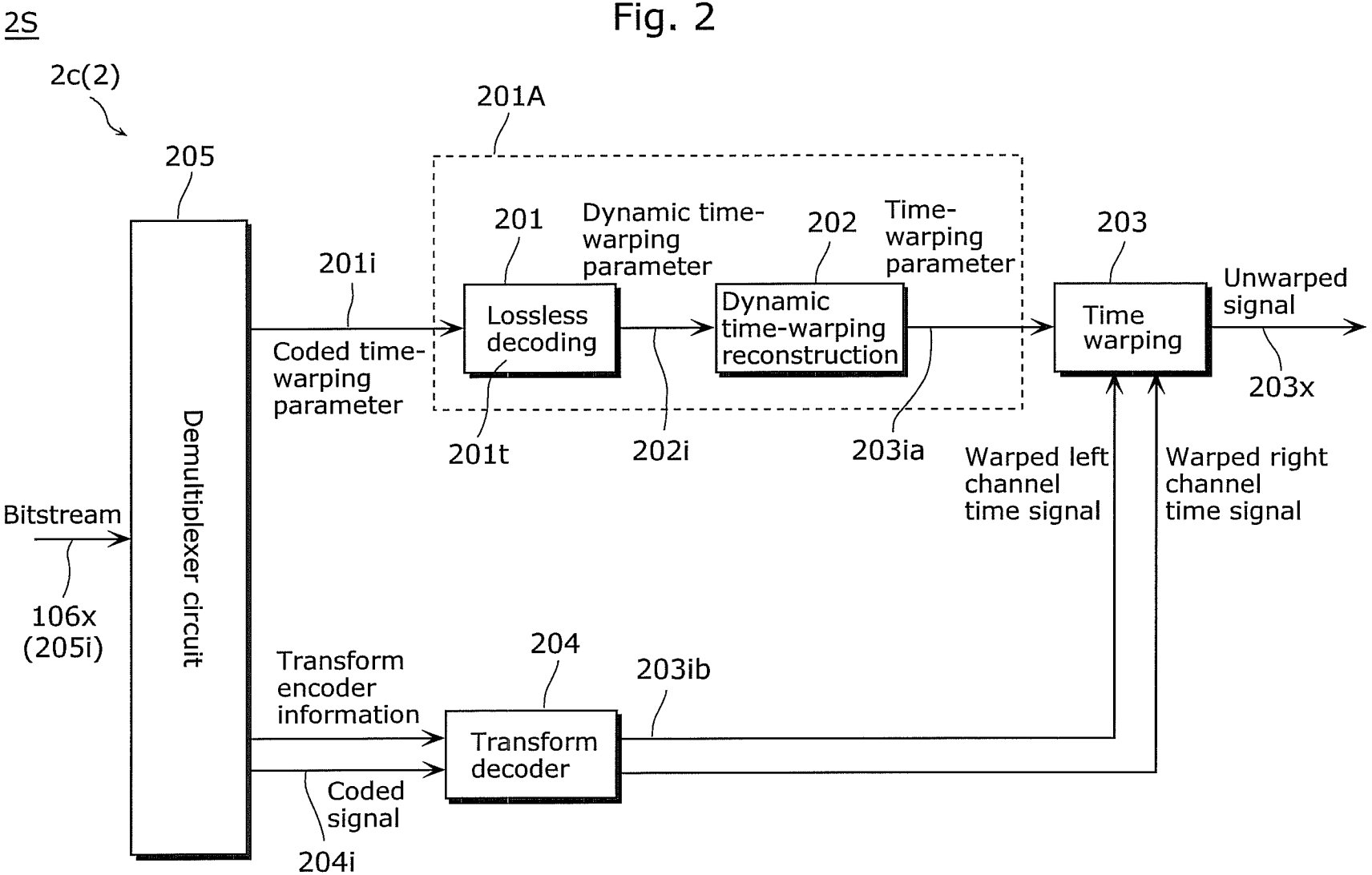
FIG. 2 is a block diagram of a decoder in which dynamic time warping is performed.

On the other hand, the decoding device (the decoding device 2 in FIG. 2) according to the embodiments of the present invention decodes a bitstream (a stream 205*i* (the stream 106*x*)) including coded data 204*i* (the third signal 105*x*) of a pitch-shifted audio signal (the second signal 203*ib* in FIG. 2) and coded pitch parameter information (parameters 201*i*, the codes 90), and includes: a demultiplexer (a demultiplexer block 205) which separates the coded data (the third signal 204*i* in FIG. 2 (the third signal 105*x* in FIG. 1)) and the coded pitch parameter information (the parameters 201*i*, the codes 90) from the bitstream to be decoded (the stream 205*i*); a first decoder (a lossless decoding block 201) which generates, from the separated coded pitch parameters (the parameters 201*i*, the codes 90), decoded pitch parameters (parameters 202*i*, the codes 90) that include pitch change ratios (the ratios 88, Tw_ratio_index, and Tw_ratio in FIG. 18) within a range (a range 86) including a range (86*a*) of the pitch change ratios (Tw_ratio: 1.0416, 1.0293, 0.9772, 0.9715, and 0.9604) corresponding to absolute pitch differences of 42 cents or larger (Cents: 60, 50, −40, −50, and −60); a pitch contour reconstructor (a dynamic time-warping reconstruction block 202) which reconstructs pitch contour information (information 203*ia*, the pitch 822) according to the generated decoded pitch parameters (the parameters 202*i*, the codes 90); a second decoder (a transform decoder block 204) which decodes the separated coded data (the signal (the third signal) 204*i*) to generate the pitch-shifted audio signal (the signal (the second signal) 203*ib*); and an audio signal reconstructor (a time-warping block 203) which transforms the pitch-shifted audio signal (the signal (the second signal) 203*ib*) into an original audio signal (a second signal 203*x*) (having a pitch specified by the reconstruction pitch contour information) according to the reconstructed pitch contour information (the information 203*ia*, the pitch 822).

Specifically, for example, in the decoding device (the decoding device 2), the first decoder (the lossless decoding block 201 in FIG. 2) decodes the separated coded pitch parameter information (the parameter 201*i* in FIG. 2, the code 90 in FIG. 18) into a pitch parameter (the ratio 88*a*) which is a pitch change ratio (the ratio 88*a*, for example, "1.0") corresponding to a relatively small absolute pitch difference in cents (0; see Cents in FIG. 18) when the coded pitch parameter information (the code 90 in FIG. 18, for example, "0") has a relatively short code length (a length of 1 bit; see Bits in FIG. 18), and decodes the separated coded pitch parameter information into a pitch parameter (the ratio 88*b*) which is a pitch change ratio (the ratio 88*b*, for example, "1.0293") corresponding to a relatively large absolute pitch difference in cents (50) when the coded pitch parameter (the code 90*b*) has a relatively long code length (for the 90*b* "111100", a length of 6 bits).

For example, a signal processing system (a signal processing system 2S) may be provided which includes an encoding device (see the encoding device 1 (FIG. 1, FIG. 20), Step S1 (FIG. 21)) and a decoding device (see a decoding device 2, Step S2) in the configuration as described below.

For example, in the encoding device (a coding device 1*a* (FIG. 1), a coding device 1*e* (FIG. 3), a coding device 1*f* (FIG. 4), a coding device 1*h* (FIG. 6), a coding device 1*i* (FIG. 7)) of the signal processing system, the pitch shifter (a time-warping unit 104) generates a second signal (a second signal 104*x*, the audio signal obtained by shifting (described above)) from a first signal (a first signal 101*i*, the input signal (described above)) by shifting the pitch of the first signal to a predetermined pitch (a reference pitch 82*r*). Next, the second encoder (the transform encoder 105) codes the generated second signal (the second signal 104*x*) into a third signal (a third signal 105*x*, data obtained by coding the audio signal output from the pitch shifter (described above)). Next, the pitch parameter generator (a pitch parameter generation unit (dynamic time-warping block) 102) calculates a pitch change ratio (a parameter 102*x* (FIG. 1), ratios 88 (FIG. 18), Tw_ratio, Tw_ratio_index) indicating the pitch (a pitch 822) of the first signal (the first signal 101*i*) before the shifting. Then, the first encoder (a lossless coding unit 103) codes the calculated pitch change ratio into a code (a code 90 (FIG. 18), a parameter (coded parameter, coded pitch parameter) 103*x* (FIG. 1)).

On the other hand, in the decoding device (a decoding device 2, a decoding device 2*c*, a decoding device 2*g* (see FIG. 2, FIG. 5, etc.)), for example, the second decoder (a transform decoder 204) decodes, into the second signal (a second signal 203*ib* (the second signal 104*x*)), the third signal (a third signal 204*i* (the third signal 105*x*)) generated by coding the second signal (the second signal 203*ib* (the second signal 104*x*)) generated from the first signal (a first signal 203*x* (the first signal 101*i*)) by shifting the pitch (the pitch 822 in FIG. 15) of the first signal (the first signal 203*x*) to the predetermined pitch (the reference pitch 82*r*). Next, the audio signal reconstructor (a time-warping unit 203) generates the first signal (the first signal 203*x*) from the second signal (the second signal 203*ib*) obtained by the decoding of the third signal. Next, the first decoder (a lossless decoding unit 201) decodes the code (a parameter 201*i* (the parameter 103*x*), the code 90 (FIG. 18)) into the pitch change ratio (a parameter 202*i* (the parameter 102*x*), the ratios 88 (the numbers of the ratios 88), Tw_ratio, Tw_ratio_index). Then, the pitch contour reconstructor (202) calculates the pitch (the pitch 822) which is indicated by the pitch change ratio (the ratio 88) obtained by the decoding of the code and used for the generation of the first signal (the first signal 203*x*) having the pitch (the pitch 822).

Techniques of such a kind of signal processing systems are still being developed (see NPL 1 to 4), and a lot remains unknown about such signal processing systems.

In other words, few engineers have known about such signal processing systems or reached a stage for starting developing new techniques for the systems.

In view of this, there may be standards for such signal processing systems to be specified by, for example, the International Organization for Standardization (ISO). The specified standards are expected to be relatively widely used.

For example, the signal processing systems according to the present invention will be in accordance with such standards to be specified in the future.

In such signal processing systems, for example, the second signal (104*x*, 203*ib*) obtained by shifting of the first signal is coded into the third signal (105*x*, 204*i*), and the third signal obtained by the coding is decode into the second signal. Sound data (the third signal) to be transferred from the encoding device to the decoding device is thereby prepared as data which is appropriate in terms of its small amount.

As a result, sound quality is not degraded but still high even with sound data in such a small amount.

In addition, by using the pitch change ratio calculated in the process, the pitch of the second signal decoded from the third signal is shifted to an appropriate pitch which the pitch change ratio specifies.

In addition, the calculated pitch change ratio is coded into a code, and the code obtained by the coding is decoded into the pitch change ratio. The data amount of the code obtained by the coding of the pitch change ratio (for example, the code 90) is smaller than the data amount of the original pitch change ratio. The amount of data of pitch to be transferred is thus reduced.

Here, in such a signal processing system (including the encoding device 1 and the decoding device 2), when the code (the code 90), which is generated by coding the pitch change ratio (the ratio 88) and to be decoded into the pitch change ratio (the ratio 88), is generated by coding a first pitch change ratio (a ratio 88*a*) corresponding to a relatively small pitch difference (close to 0 cent) in comparison with a pitch change ratio corresponding to a pitch difference of zero cent (a ratio 88*x* of 1.0 in FIG. 18), the code (the code 90) is a first code having a relatively short code length (a code 90*a*). When the code (the code 90) is generated by coding a second pitch change ratio (a ratio 88*b*) corresponding to a relatively large pitch difference (close to 50 cents), the code is a second code having a relatively long code length (a code 90*b*).

The inventors found through experiments that, in many cases, pitch change ratios corresponding to small pitch differences (the ratios 88*a*) occurred at a higher frequency, and pitch change ratios corresponding to large pitch differences (the ratios 88*b*) occurred at a lower frequency.

Thus, the inventors proposes that variable-length coding may be applied according to closeness to (or depending on the difference from) the ratio 88*x* corresponding to the pitch difference of zero cent. This saves the size of data of the third signal (the signal 105*x*, the signal 204*i*), and therefore the amount of pitch data (the signal 103*x* and the signal 201*i*) to be transferred is sufficiently reduced.

For example, in such a signal processing system, an operation (S1 and S2 in FIG. 21) in which the encoding device generates the third signal (the third signal 204*i*, the signal 105*x*) by coding the second signal (the signal 104*x*, the signal 203*ib*) generated by the shifting of the first signal and the decoding device decodes the third signal, is performed only when a difference between the pitch change ratio (the ratio 88) of the pitch (the pitch 822) of the first signal (the signal

101*i*, the signal 203*x*) before the shifting and the pitch change ratio of zero cent (the ratio 88*x*) is equal to or smaller than a threshold (0.0416=max{1.0416−1=0.0416, 1−0.9604=0.0396} in FIG. 18), and not generated when the difference is larger than the threshold (the difference <0.0416).

Figure 19:
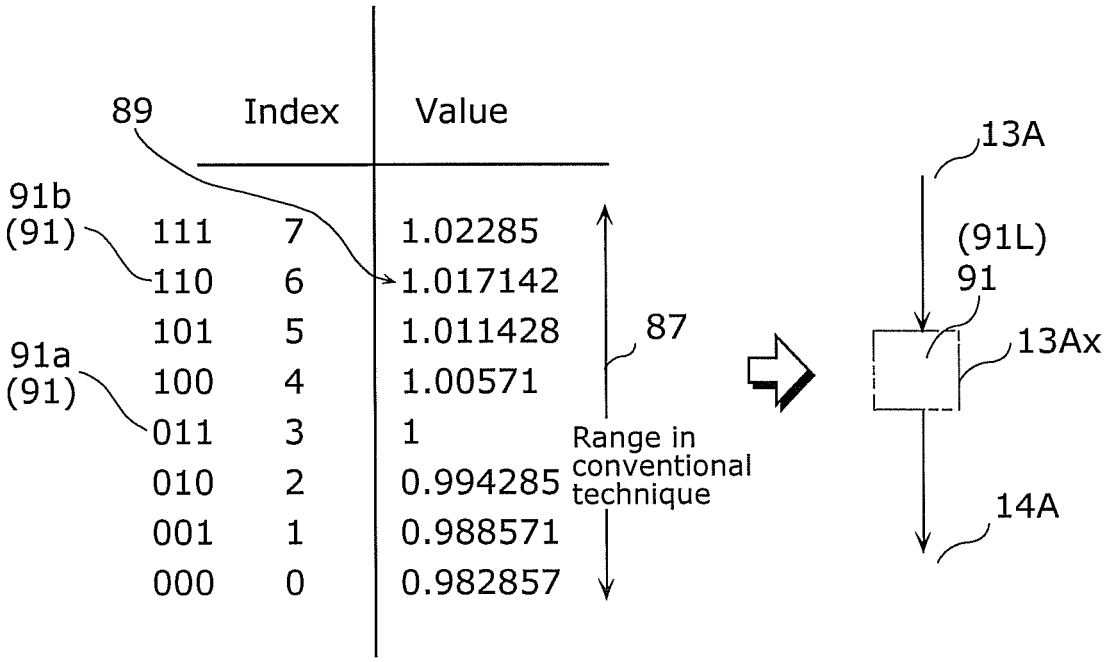
FIG. 19 illustrates a table in a conventional technique.

For example, the threshold is not a value for a musical interval smaller than 42 cents (for example, 1.02285−1=0.02285 in the conventional technique in FIG. 19) but a value for a musical interval equal to or larger than 42 cents (for example, 0.0416 as shown above).

In other words, the threshold at which the operation is switched between enabled or disabled may be set to a great value (in comparison with the threshold "0.02285" used in the conventional technique, see FIG. 19). For example, the threshold may be 0.0416 obtained by max{1.0416−1=0.0416, 1−0.9604=0.0396} (see FIG. 18).

Therefore, the operation may be performed for the pitch change ratios (the ratios 88) over a range such as a range 86 wider than a range 87, which is the range of the pitch change ratio in the conventional techniques (see FIG. 18).

In this configuration, pitch change ratios over such a wider range are coded, and therefore the code 90 (the Data 90L in FIG. 22) obtained by the coding is provided in a sufficient amount. The data 90L obtained by the coding is therefore not in an insufficient amount which is, for example, much smaller than the amount of data 91L obtained by coding using a fixed-length code 91 as in the conventional technique (see FIG. 19), but in an appropriate amount. The appropriate amount is, for example, relatively close to (or as large as) the amount of the data 91L.

The range (or the threshold) of the pitch change ratios is an appropriate range (or an appropriate threshold) such that the amount of data 90 (the data 90L) obtained by the coding is relatively close to the amount of data obtained by a fixed-length coding (for example, the data 91L in the conventional techniques).

The inventors also found through experiments that, in many cases, the obtained ratio 88 was a pitch change ratio in the range 86*a*, that is, a pitch change ratio of a pitch (for example, the pitch 822 in FIG. 15) which is different from the previous pitch (for example, the pitch 821 in FIG. 15) by a large number of cents (which are larger than 42 cents).

In view of this, even when a pitch change ratio (the ratio 88) for such a large pitch difference occurs, the pitch change ratio is still within the wider range (the range 86) and the third signal 105*x* is generated. Therefore, signals for sound having quality lower than the quality of sound represented by the third signal 105*x* are not generated, so that the quality of sound in this system is high.

In this configuration, the range of pitch change ratios is appropriate and quality of obtained sound is high.

It is to be noted that the code 90*a* having a shorter length (of 1 bit) is one of the codes 90 corresponding to pitch change ratios 88*a* within the range 87 in which the pitch differences are smaller than 42 cents as shown in FIG. 18, for example. On the other hand, the code 90*b* having a longer length (of 6 bits) is cone of the codes 90 corresponding to pitch change ratios 88*b* within the range 86*a* in which the pitch differences are 42 cents or larger, for example.

Figure 13:
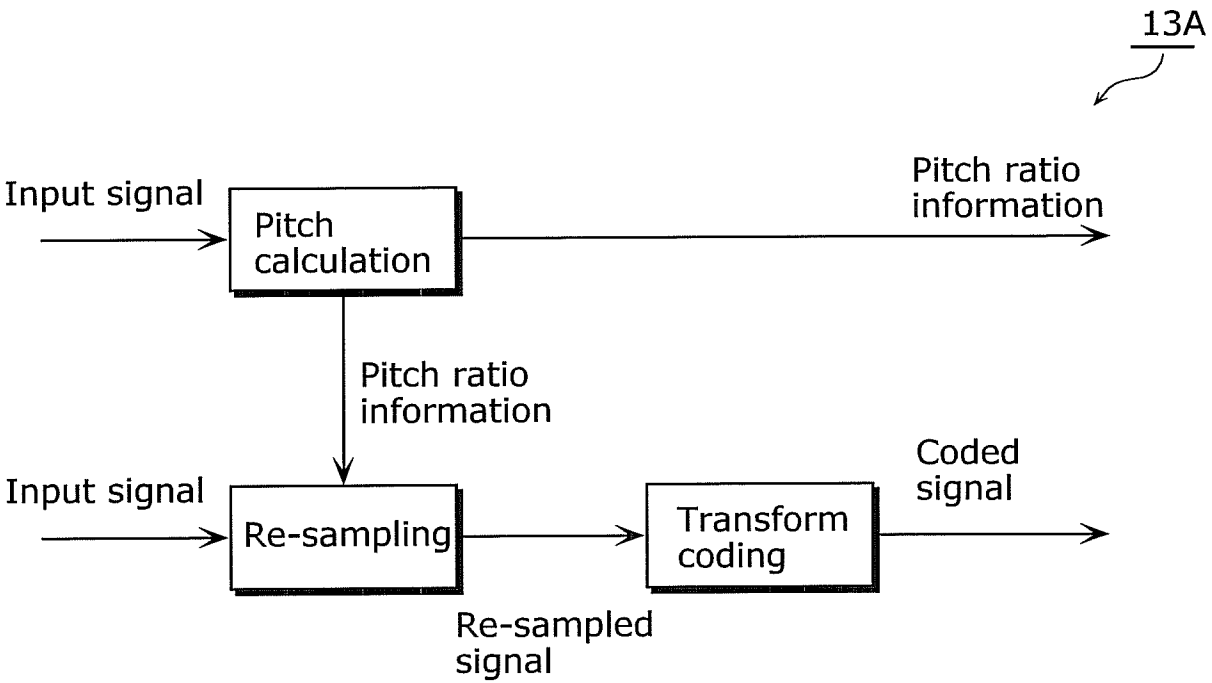
FIG. 13 is a block diagram of time warping in an encoder.
Figure 14:
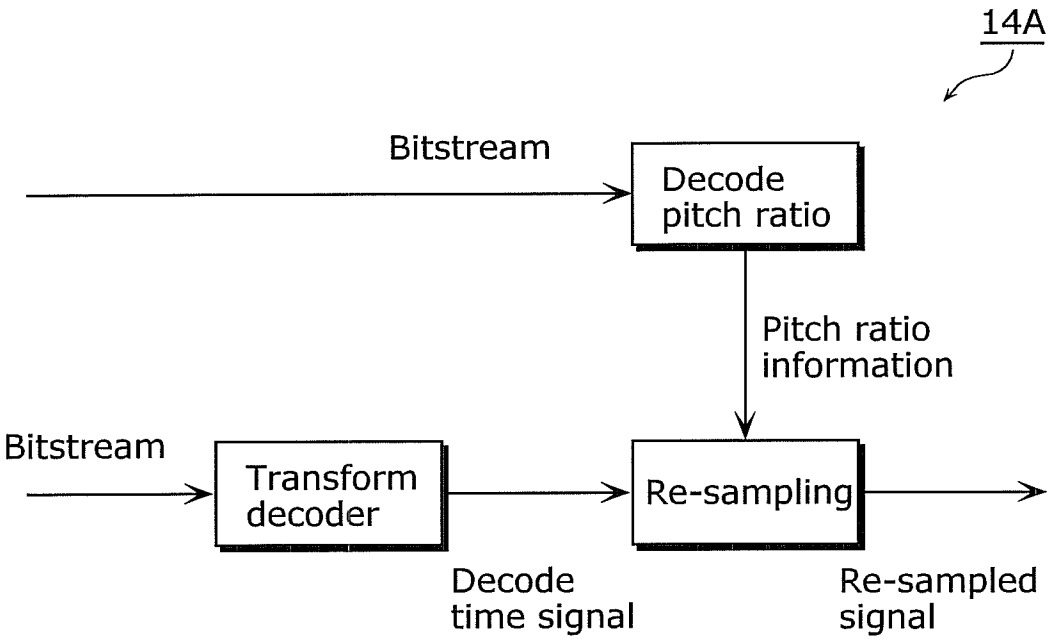
FIG. 14 is a block diagram of time warping in a decoder.

In contrast, in the conventional techniques (shown in FIG. 19, FIG. 13, and FIG. 14) those skilled in the art had not noticed that there occur many pitch change ratios corresponding to pitch differences larger than 42 cents (the ratio 88*b* within the range 86*a*). That is, it was unknown that the occurrence of many pitch change ratios within the range 86*a* was a cause of low sound quality. It is therefore difficult to arrive at the configuration according to the present invention from the conventional techniques (FIG. 19, FIG. 13, and FIG. 14).

The threshold ("0.0416" in the above description) is, for example, a value for the cents largest in absolute values (1.0416) within the range of the pitch change ratios (the range 86 in FIG. 18: 1.0416 to 0.9604). A threshold of such a high value (for example, the value of 0.0416) allows the range 86 to be a wider range including not only the range 87 of the pitch change ratios corresponding to the pitch differences smaller than 42 cents (see 1.02285 to 0.982857 in FIG. 19) but also the range 86*a* of the pitch change ratios corresponding to the pitch differences of 42 cents or larger (the range of 1.0416 to 1.0293 and 0.9772 to 0.9604 in FIG. 18).

These processes (and configurations and technical features) may be used in combination to produce a synergistic effect.

It is to be noted that these process have in common that they are all used as components for the synergistic effect, and are within a single technical scope.

On the other hands, in known techniques (for example, see FIG. 19, FIG. 13, and FIG. 14), all or part of them is missing so that such a synergistic effect is not produced. In this respect, the techniques according to the present invention are distinguishable from the conventional techniques.

The following embodiments are merely illustrative for the principles of the various inventive steps of the present invention. It should be understood that variations of the embodiments described herein will be apparent to those skilled in the art.

(First Embodiment)

An encoding device using a dynamic time-warping scheme according to the first embodiment is proposed in the following.

FIG. 1 illustrates an example of the proposed encoder (encoding device).

In FIG. 1, one frame of each of a left signal and a right signal is sent to a block 101, which is a pitch contour analysis block. In the block 101 (the pitch contour analysis block (or a pitch contour analysis unit) 101), pitch contours of two channels (left and right channels) are calculated separately. That is, a pitch contour is calculated for each of the channels. The pitch contour detection algorithm described in the conventional techniques, for example, may be used here (in the pitch contour analysis unit 101).

Figure 8:
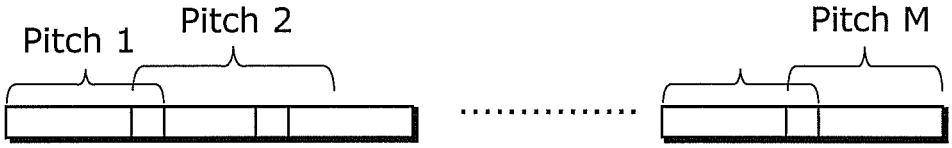
FIG. 8 illustrates segmentation of one audio frame.

Next, each of the frames is segmented into M overlapping sections as illustrated in FIG. 8. Then, M pitches are calculated from the M sections within one frame.

The pitch contours of the left and right channels extracted in the block 101 are sent to a block 102, which is a dynamic time-warping block. In the block 102, pitch parameters are generated based on information of the extracted pitch contours. The information of the extracted pitch contours includes pitch change section information in each audio frame (time-warping positions) and corresponding pitch change ratios of the adjacent sections (time-warping values). Hereinafter, the pitch parameters are also referred to as dynamic time-warping parameters.

The dynamic time-warping parameters are sent to a block 103, which is a lossless coding block. In the lossless coding block, the time-warping values are further compressed into coded time-warping parameters. In the block 103, for example, a general lossless coding technique is used.

Next, the resulting coded time-warping parameters are sent to a block 106, which is a multiplexer (a multiplexer block or a multiplexer circuit), and then the block 106 generates a bitstream.

The dynamic time-warping parameters are sent to a block 104, which is a time-warping block. In the process of the block 104, a technique described in the conventional techniques may be used. In the block 104, input signals are resampled according to the time-warping parameters. For stereo coding, the left signal and the right signal are pitch-shifted (time-warped) separately according to the respective dynamic time-warping parameters.

The time-warped signals are sent to a block 105, which is a transform encoder.

The coded signals and relevant information are also sent to the block 106, that is, the multiplexer.

It is to be noted that the input signals of the block 101 in this first embodiment are not necessarily stereo signals. It may be a monaural signal or multiplex signals. The dynamic time-warping scheme is applicable to any number of channels.

(Advantageous Effects)

In the first embodiment, a pitch contour is processed by a dynamic time-warping scheme so that dynamic time-warping parameters are generated. The resulting dynamic time-warping parameters represent positions where time warping is applied and time-warping values corresponding to the respective positions. The proposed dynamic time-warping scheme improves sound quality. Lossless coding is also used in order to further reduce the number of bits to be used for coding the time-warping values.

(Second Embodiment)

The following describes a method of dynamic time warping of time-warping parameters using a coding scheme with increased efficiency according to the second embodiment.

As explained in the Technical Problem, pitch detection is difficult because of change in the amplitude and cycle of a signal. Then, inaccuracy in a pitch contour affects performance of time warping if such pitch contour information is directly used for time warping. Since harmonics of a signal are modified in proportion to pitch shifting during time warping, it is necessary to take into account effects of the time warping on the harmonics.

In the time-warping method according to the second embodiment, a pitch contour is modified on the basis of an analysis of a harmonic structure of an audio signal, so that more efficient dynamic time-warping parameters are generated. The method is composed of three parts.

In the first part, a pitch contour is modified according a harmonic structure.

In the second part, performance of time warping is evaluated by comparing the harmonic structures before and after time warping.

In the third part, an efficient representation scheme of the dynamic time-warping parameters is used.

Instead of coding the whole pitch contour as described in the conventional techniques described in [3] and [4], only the information on positions where time warping is applied is coded, and the time-warping values corresponding to the respective positions are coded using a lossless coding method.

In the first part, a pitch contour is modified. Each of the audio frames is segmented into M sections for pitch calculation as in the first embodiment. The pitch contour includes M pitch values ($pitch_1$, $pitch_2$, . . . , $pitch_M$). In the conventional techniques described in [3] and [4], the pitch is shifted close to a reference pitch value. A consistent reference pitch is obtained after time warping.

The proposed dynamic time warping herein allows shifting the harmonics of a signal close to the harmonics of the reference pitch value.

Figure 17:
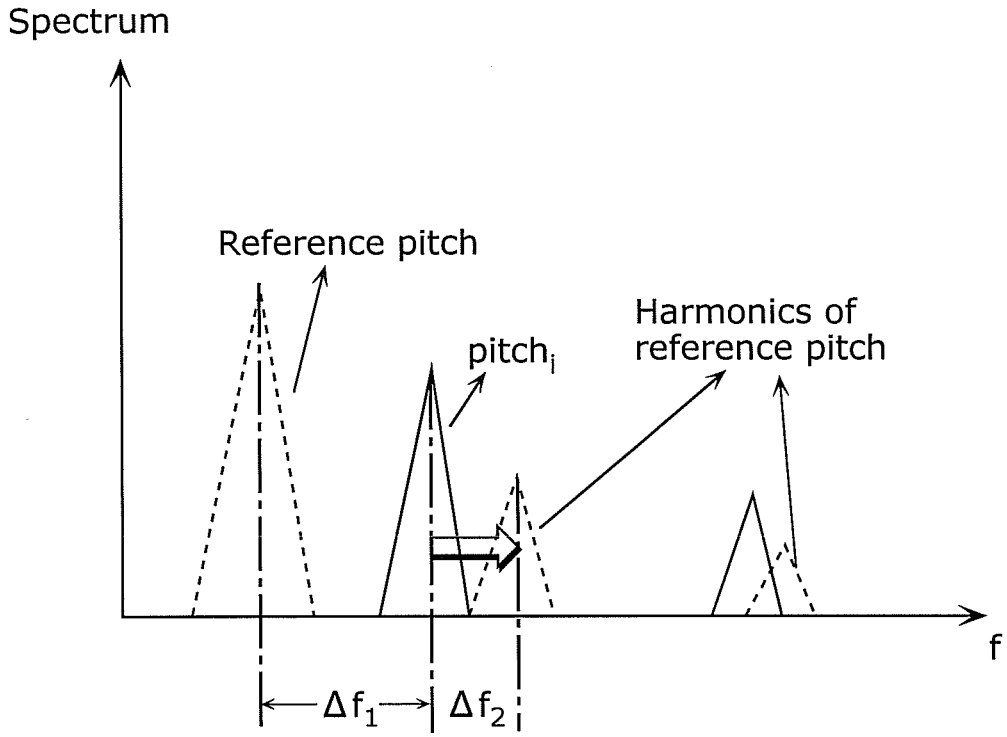
FIG. 17 illustrates the pitch shifting using harmonics.

FIG. 17 illustrates the pitch shifting using harmonics.

This is an example of such a pitch shifting. Referring to FIG. 17, the three dashed lines indicate a reference pitch and the harmonics of the reference pitch. In FIG. 17, the detected pitch is close to one of the harmonics of the reference pitch and $\Delta f1 > \Delta f2$. That $\Delta f1 > \Delta f2$ means that a larger warping value ($\Delta f_1$ in FIG. 17) is used for shifting the detected pitch to the reference pitch, and a smaller warping value ($\Delta f_2$ in FIG. 17) is used for shifting the detected pitch to the harmonic of reference pitch.

The dynamic time warping modifies the pitch contour and allows shifting of harmonic components. The processes of the modification are detailed in the following.

In the proposed dynamic time warping, the differences between detected pitches and reference pitches are compared.

$pitch_{ref}$ in Eq. 2 (Math. 2) below represents a reference pitch value. $pitch_i$ represents the detected pitch value of a section i.

If $pitch_i > pitch_{ref}$, a determination is made as to whether $pitch_i$ is closer to $pitch_{ref}$ or to the harmonics of the reference pitch value, that is, $k \times pitch_{ref}$, where k is an integer greater than one.

If k exists satisfying $$|pitch_i - pitch_{ref}| > |pitch_i - k \times pitch_{ref}| \quad \text{[Eq. 2]},$$

the value $pitch_i$ should be shifted to the harmonic of the reference pitch value for the value of k, that is, $k \times pitch_{ref}$. The detected $pitch_i$ is modified to $pitch_i/2$.

If $pitch_i < pitch_{ref}$, a determination is made as to whether $pitch_{ref}$ is closer to $pitch_i$ or the harmonics of $pitch_{ref}$. If k exists satisfying $$|pitch_i - pitch_{ref}| > |k \times pitch_i - pitch_{ref}| \quad \text{[Eq. 3]},$$

the harmonic of $pitch_i$ should be shifted to the reference pitch. Therefore, $pitch_i$ is modified to $k \times pitch_i$.

In the second part, based on the modified pitch contour, time warping is applied and performance is evaluated by comparing the harmonic structures before and after the time warping. The summation of the harmonic components before the time warping and the summations of the harmonic components after the time warping are used as the criteria for the performance evaluation in the second embodiment.

The harmonic of a pitch value of a section i is calculated as follows:

$$H(pitch_i) = \sum_{k=1}^{q} S(k \times pitch_i). \quad \text{[Eq. 4]}$$

Here, q is the number of harmonic components. In the second embodiment, q=3 is suggested. S(•) denotes the spectrum of the signal. $pitch_i$ is the detected pitch value of $pitch_1$, $pitch_2$, . . . , and $pitch_M$ included in the pitch contour.

After time warping, the summation of the harmonics is calculated using the following equation:

$$H'(pitch_i) = \sum_{k=1}^{q} S'(k \times pitch_i). \quad \text{[Eq. 5]}$$

S'(•) denotes the spectrum of the signal after the time warping.

Before the time warping, the signal consists of harmonics of $pitch_1$, $pitch_2$, . . . , $pitch_M$. A harmonic ratio HR is defined as follows to represent the energy distribution among these harmonic components:

$$HR = \frac{\max(\hat{H})}{\min(\hat{H})}. \quad \text{[Eq. 6]}$$

$$\hat{H} \quad \text{[Eq. 7]}$$

is the summation of the harmonics of the pitches $pitch_1$, $pitch_2$, . . . , $pitch_M$.

After the time warping, the harmonic ratio is calculated using the following equation:

$$HR = \frac{\max(H'(pitch_{ref}))}{\min(\hat{H}')}. \quad \text{[Eq. 8]}$$

$H'(pitch_{ref})$ is the summation of the harmonics of the reference pitch after the time warping.

$$\hat{H}' \quad \text{[Eq. 9]}$$

is a summation of the harmonics of the pitches $pitch_1$, $pitch_2$, . . . , $pitch_M$ after the time warping.

Energy is expected to be confined to the reference pitch after the time warping. Energy of the other pitches is depressed. Therefore, HR' is expected to be greater than HR. Time warping is considered effective when HR' is greater than HR, and therefore applied to this frame.

In the third part of the dynamic time warping, dynamic time-warping parameters are generated using an efficient scheme. Since there are not so many pitch change positions in a frame, it is possible to design an efficient scheme such that the pitch change positions and the values $\Delta p_i$ are coded separately.

First, the modified pitch contour is normalized. Next, a difference between adjacent modified pitches is calculated using the following equation.

$$\Delta p_i = \frac{pitch_i}{pitch_{i-1}} \quad \text{[Eq. 10]}$$

Unlike with the conventional techniques disclosed in [3] and [4], in the dynamic time warping, not the whole vector of $$\Delta\hat{p} \quad \text{[Eq. 11]}$$

is coded but a vector C is used to indicate the position where $\Delta p_i \neq 1$, and it is the position where time warping is applied. Only those time-warping values $\Delta p_i$ which are not equal to 1 are coded using the lossless coding technique.

If $\Delta p_i = 1$, C(i) is set to 1, otherwise C(i) is set to 0. Each element of the vector C corresponds to one section of the modified pitch contour.

Figure 9:
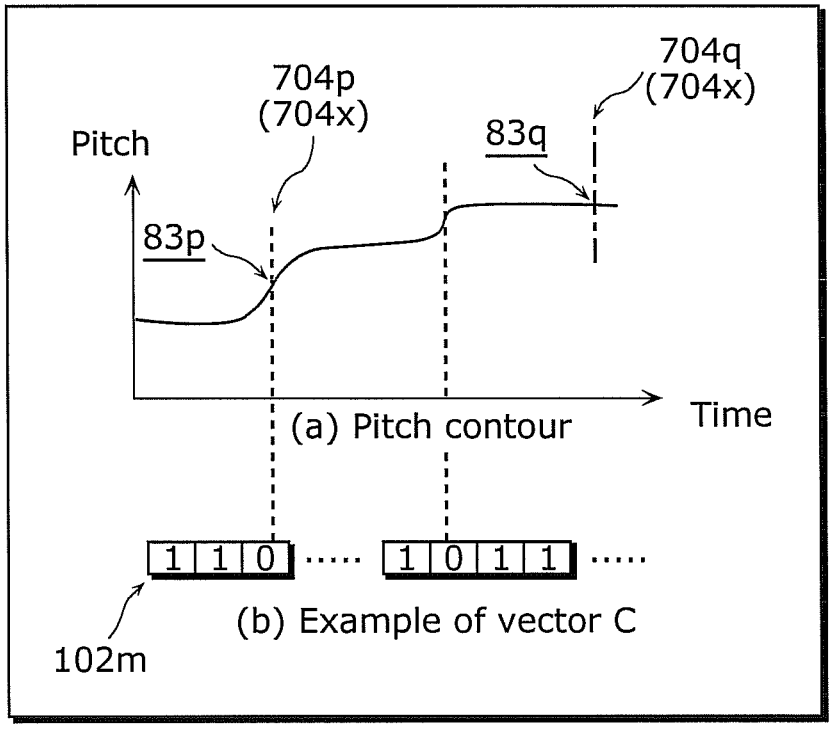
FIG. 9 illustrates calculation of a vector C.
Figure 10:
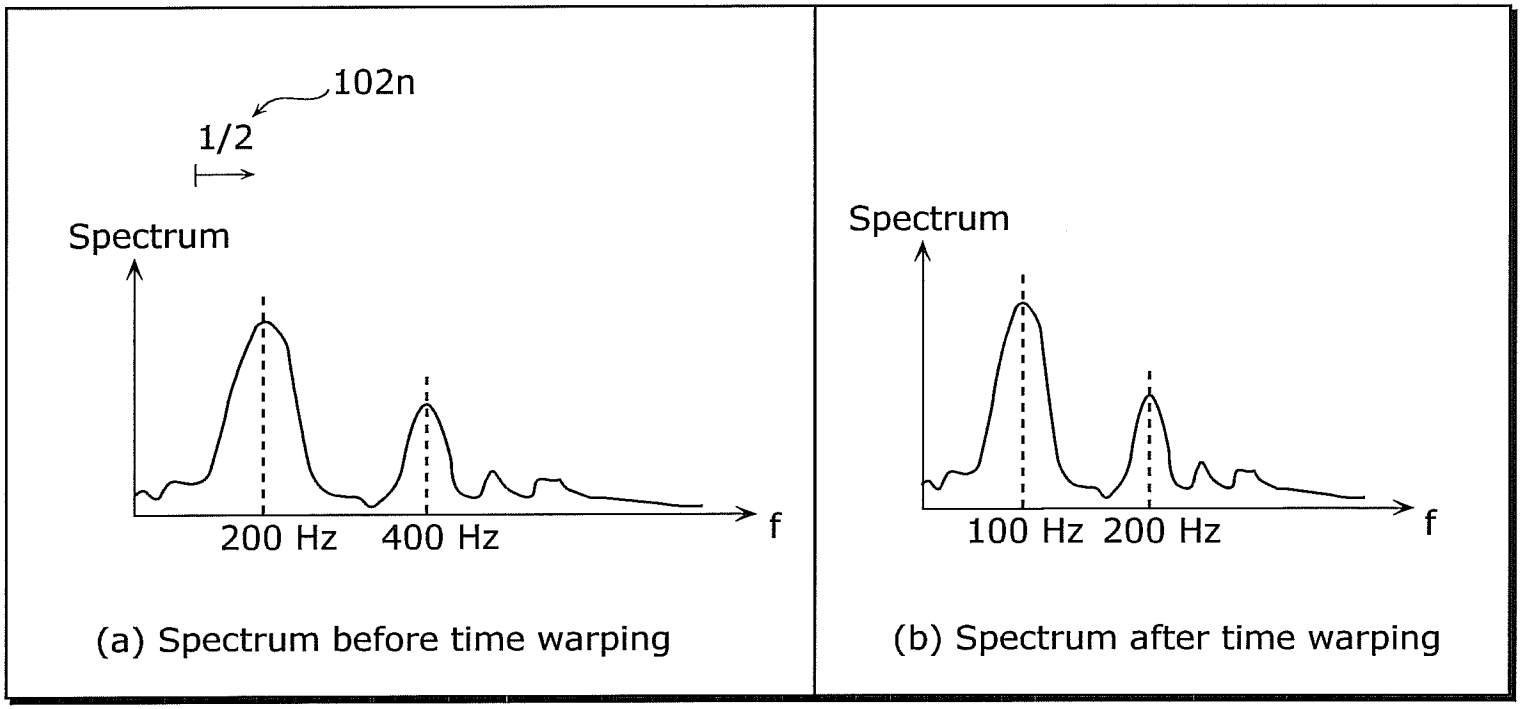
FIG. 10 illustrates pitch shifting.

FIG. 9 illustrates calculation of the vector C.

This is an example of setting of the vector C. N is defined as the number of sections in which the pitch changes and $\Delta p_i * 1$.

A dynamic scheme is used to code the vector C and the time-warping values $\Delta p_i$ which are not equal to 1. A flag A is then generated to indicate which scheme is selected.

First, a determination is made as to whether or not there is any pitch change point in the frame. When N is 0, there is no pitch change point in the frame. Then, the flag A is set to 0; in this case, only the flag A is sent to the block 103, which is the lossless coding block.

If there are one or more pitch change points, time-warping values $\Delta p_i$ not equal to 1 and the vector C need to be sent to the decoder.

If $$N \times \log_2 M + \log_2\left(\frac{M}{\log_2 M}\right) > M, \quad \text{[Eq. 12]}$$

there are many pitch change points in the frame. In this case, it is more efficient to directly code the vector C and $\Delta p_i$ not equal to 1. Next, the flag A is set to 1; M bits are used to code the vector C. For example, when the vector C is 00001111, eight bits are used to represent the vector C. Then, the flag A, the vector C, and $\Delta p_i$ not equal to 1 are sent to the lossless coding block 103.

On the other hand, if N>0 and $$N \times \log_2 M + \log_2\left(\frac{M}{\log_2 M}\right) \leq M, \quad \text{[Eq. 13]}$$

there is a small number of pitch change points in the frame. In this case, it is more efficient to directly coding the positions of the pitch change points. Next, the flag A is set to 2; $\log_2 M$ bits are used to code the position marked as 0 in the vector C.

$$\log_2\left(\frac{M}{\log_2 M}\right) \quad \text{[Eq. 14]}$$

bits are used to code N, the number of the pitch change points.

For example, when the vector C is 10111111, the position of the pitch change point is a position 2, and three bits are used to code the position 2. The flag A, the number of the pitch change points N, the pitch change positions, and $\Delta p_i$ not equal to one are sent to the block 103.

As described above, after the statistical analysis of $\Delta p_i$, the probability of occurrence of values $\Delta p_i$ is not even. Lossless coding may be therefore used to save bitrate. The processes of the lossless coding 103 (the lossless coding block 103) may be performed by arithmetic coding or Huffman coding so that the selected pitch ratio $\Delta p_i$ is coded, where $\Delta p_i \neq 1$.

In order to reduce the complexity, only the first two schemes may be used in the block 102.

(Advantageous Effects)

The dynamic time warping allows reconstruction of a harmonic structure through time warping. Since the energy is confined to a reference pitch and harmonic components of the reference pitch, coding efficiency is improved. The evaluation scheme makes time warping less dependent on accuracy in pitch detection, and thereby performance of the coding system is improved. The efficient scheme for coding time-warping parameters improves sound quality while reducing necessary bitrate, supporting coding of a signal with a larger pitch change rate.

(Third Embodiment)

A decoding device using a dynamic time-warping scheme according to the third embodiment is proposed in the following.

FIG. 2 illustrates a block diagram of the third embodiment.

In a block 205, which is a demultiplexer, the input bitstream is separated into the coded time-warping parameters, the coded audio signal, and the relevant transform encoder information.

The coded time-warping parameters are sent to a block 201, which is a lossless decoding block. In this block, the dynamic time-warping parameters are generated.

The dynamic time-warping parameters include the flag, the information on positions where time warping is applied, and the corresponding time-warping values $\Delta p_i$.

The dynamic time-warping parameters are sent to a block 202, which is a dynamic time warping-reconstruction block. In the block 202, the dynamic time-warping parameters are decoded into the time-warping parameters.

In a block 204, which is a transform decoder, the coded signal is decoded on the basis of transform encoder information received from the demultiplexer block 205. In the block 204 the coded signal is decoded into the time-warped signal.

A time-warping block 203 receives the time-warped signal and applies time warping on the received signal. The process of the time warping is the same as the process performed in the block 104 in the first embodiment. The signal is unwarped according to the time-warping parameters and the audio signal.

(Fourth Embodiment)

The following describes a specific example of the dynamic time-warping reconstruction according to the fourth embodiment.

Dynamic time-warping parameters received by the dynamic time-warping reconstruction block include the flag, the information on positions where time warping is applied, and the corresponding time-warping values $\Delta p_i$.

First, the flag is checked. If the flag is 0, no time warping is applied on the current frame. In this case, all the values of the reconstructed pitch contour vector are set to 1.

If the flag is 1, M bits are used to code the vector C which indicates positions where time warping is applied. One bit is matched to one position. The value 1 is used as a mark indicating no pitch change, and the value 0 is used as a mark indicating time warping. The total number of time-warping points N is known by counting the number of the values 0 in the vector C. In the process, N time-warping values $\Delta p_i$ are obtained from a buffer. $\Delta p_i$ correspond to the time-warping values, where c(i)=0.

The pseudo code is as follows:

[Eq. 15]

```
For i=0:M
    Pitch_ratio[i]=1;
If flag==1
  For i=1:M
{
    Read(vector C(i))
    If vector C(i)==0
    {
     Read(ratio);
    Pitch_ratio[i]= ratio;
    }
}
```

If the flag is 2, the number of time-warping points N is read from the buffer. Then, the N time-warping positions are read from the buffer. At last, the pitch ratios corresponding to the respective time-warping points are obtained from the buffer. The pseudo code is as follows:

[Eq. 16]

```
For i=0:M
    Pitch_ratio[i]=1;
If flag==2
{
  Read(N)
  For i=1:N
  {
     Read(position J)
     Read (ratio)
     Pitch_ratio[J]=ratio;
  }
}
```

The normalized pitch contour is reconstructed using the following equation:

$$pitch_i = pitch_ratio(i) \times pitch_{i-1} \quad \text{[Eq. 17]}$$

The pitch contour is used for time warping later.

(Fifth Embodiment)

An encoding device using a dynamic time-warping scheme according to the fifth embodiment is proposed in the following.

Figure 3:
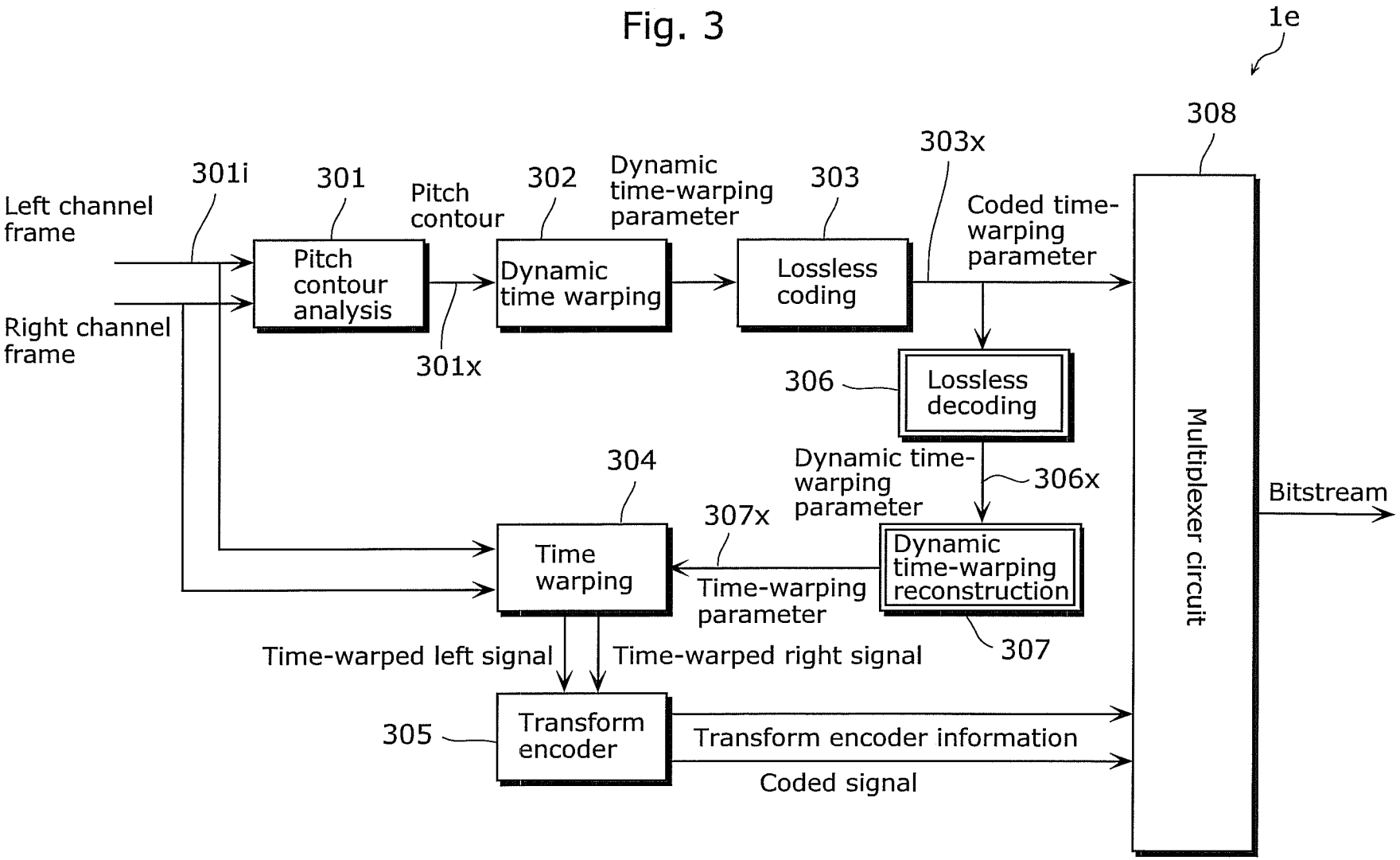
FIG. 3 is a block diagram of a decoder in which a modification of dynamic time warping is performed.

FIG. 3 illustrates a proposed encoder.

The difference between the coding system shown in FIG. 1 and the encoder shown in FIG. 3 is in blocks 306 and 307. The function of a lossless decoding block 306 in FIG. 3 is the same as the function of the block 201 in FIG. 2. A dynamic time-warping reconstruction block 307 is the same as the block 202 in FIG. 2.

In the configuration shown in FIG. 3, the encoder uses exactly the same time-warping parameters as the decoder.

In the fifth embodiment, accuracy in the time warping by the encoder is increased.

(Sixth Embodiment)

An encoding device which incorporates the middle and side stereo mode (M-S mode) according to the sixth embodiment is described in the following.

Figure 4:
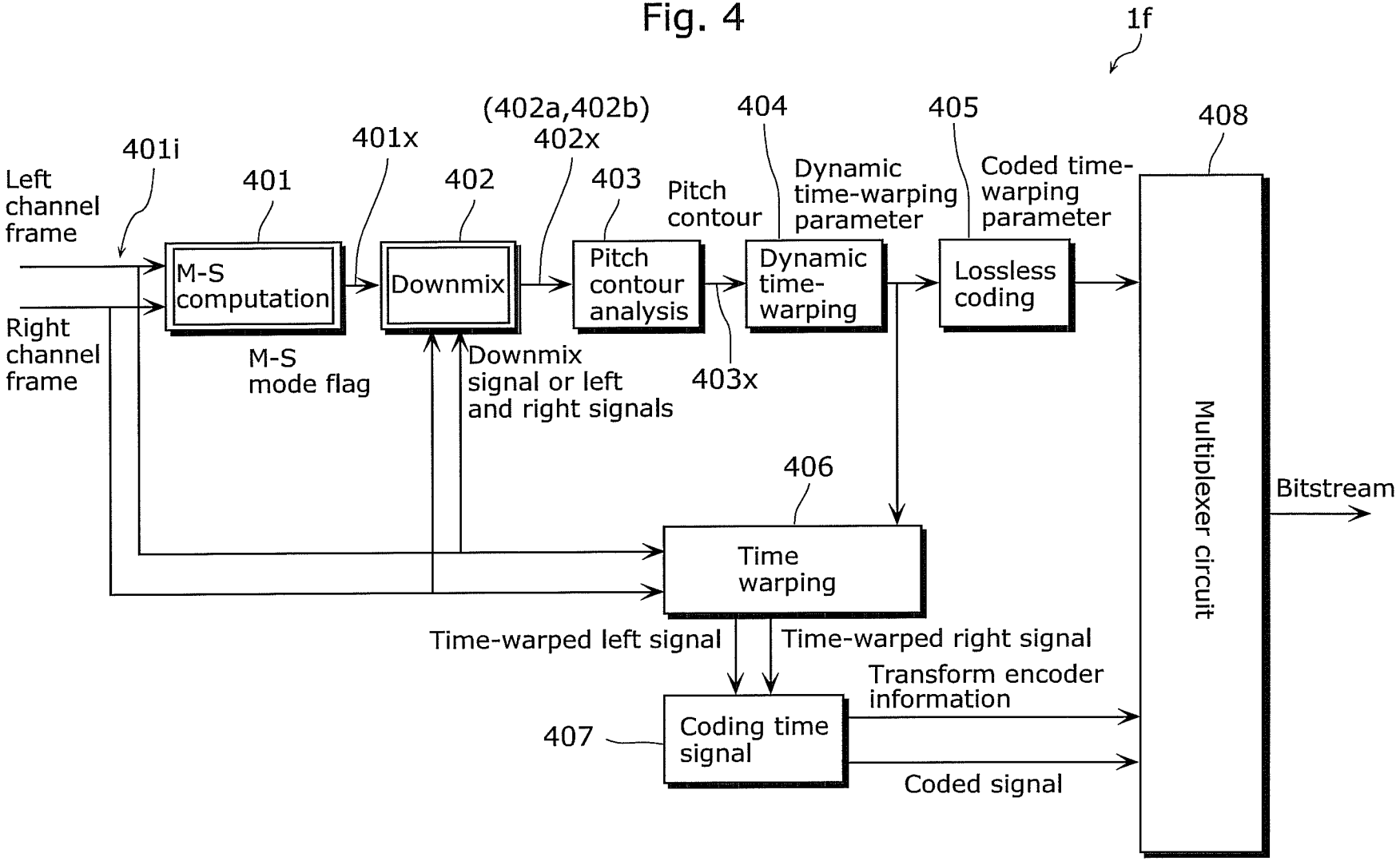
FIG. 4 is a block diagram of an encoder in which dynamic time warping using an M-S mode is performed.

FIG. 4 illustrates a configuration of the encoding device according to the sixth embodiment.

The M-S mode is often used for coding stereo audio signals in many transform codecs, for example, the AAC codec.

The M-S mode is used to detect similarity between left and right channel subbands in frequency domain. The M-S stereo mode is activated when the subbands of left and right channels are similar. Otherwise the M-S mode is not activated.

Since M-S mode information is available for a lot of transform coding, used of the M-S mode information may be made for dynamic time warping to improve performance of harmonic time warping.

FIG. 4 illustrates a configuration in which the M-S mode information provided from the transform codec is used.

First, a left channel signal and a right channel signal are sent to a block 401, which is an M-S computation block. In the M-S computation block, similarity between the left channel signal and the right channel signal is calculated in frequency domain. It is the same as the M-S detection in general transform coding. Next, a flag is generated in the block 401. When the M-S mode is activated for all the subbands of the stereo audio signals, the flag is set to 1. Otherwise the flag is set to 0.

When the flag is 1, the left channel signal and the right channel signal are downmixed into a middle signal and a side signal in a block 402, which is a downmix block. The middle signal is sent to a block 403, which is a pitch contour analysis block.

Otherwise the original stereo signal is sent to the block 403.

In the block 403, which is a pitch contour analysis block, pitch contour information is calculated as in the block 102 in FIG. 1. For the downmixed signal, one set of pitch contours is generated. Otherwise pitch contours of the left signal and the right signal are separately generated.

The operations of blocks 404, 405, 406, and 408 are the same as the operations of the blocks 103, 104, 105, and 196, respectively.

(Advantageous Effects)

In the sixth embodiment, dynamic time warping is modified to be more suitable for stereo coding. In stereo coding, left and right channels sometime have different characteristics. In this case, different time-warping parameters are calculated for different channels. In some cases, the left and right channels have similar characteristics. In this case, it is reasonable to use the same time-warping parameters for both the channels. When left and right channels are similar, more efficient audio coding can be achieved by using the same set of time-warping parameters.

(Seventh Embodiment)

The following describes a decoding device which supports the M-S mode according to the seventh embodiment.

Figure 5:
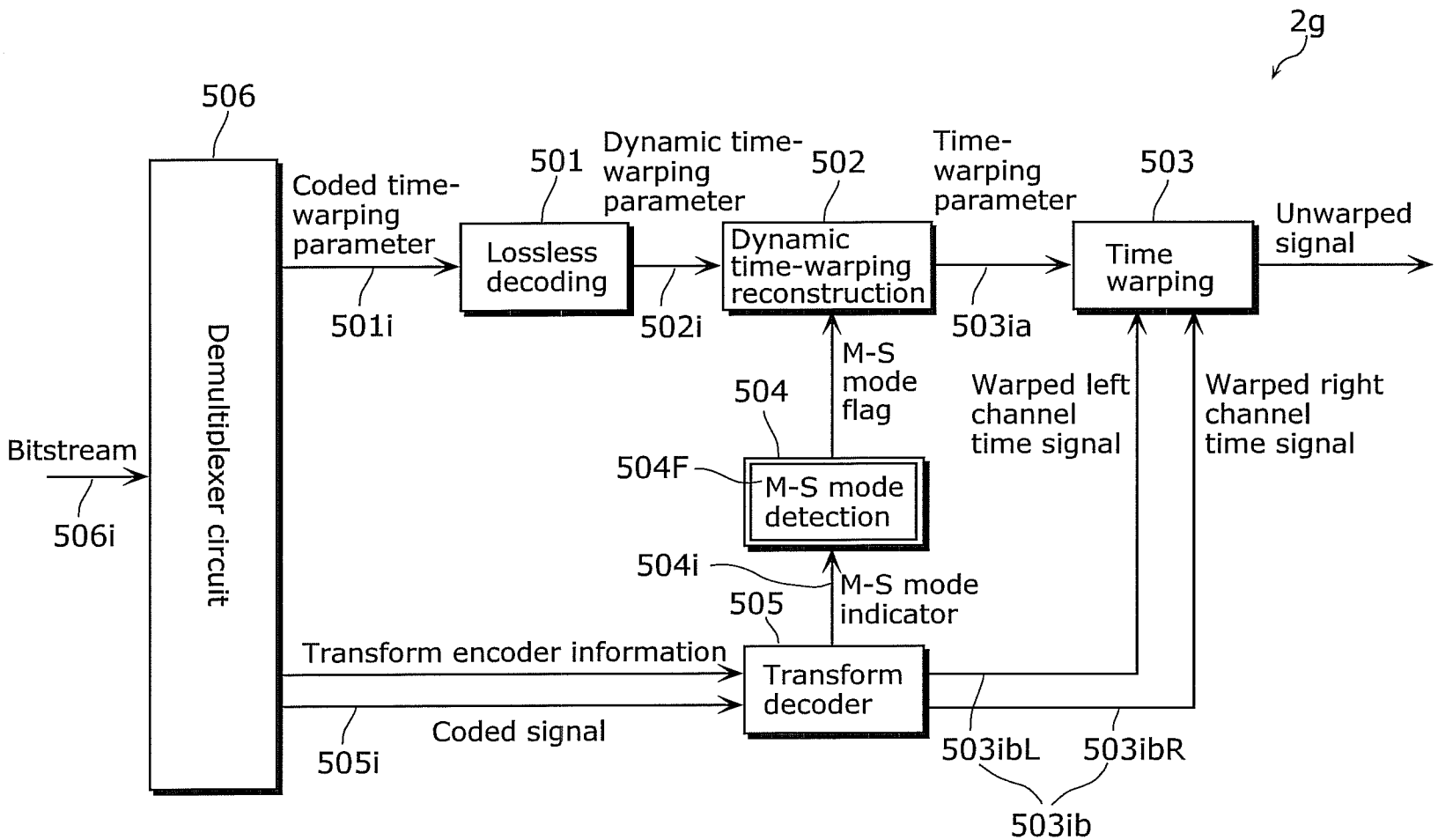
FIG. 5 is a block diagram of a decoder in which dynamic time warping using an M-S mode is performed.

FIG. 5 illustrates a block diagram of a decoding device according to the seventh embodiment.

The bitstream is input to a demultiplexer block 506.

The block 506 outputs the coded time-warping parameters, the transform encoder information, and the coded signal.

In a block 505, which is a transform decoder, the coded signal is decoded into the time-warped signal according to the transform encoder information, and extracts the M-S mode information.

The M-S mode information is sent to a block 504, which is an M-S mode detection block.

When the M-S mode is activated for all the subbands for a frame, the M-S mode is also activated for the time warping and a flag is set to 1. Otherwise the M-S mode is not used in harmonic time-warping reconstruction, and the flag is set to 0. The M-S mode flag is sent to a block 502, which is a harmonic time-warping reconstruction block.

The dynamic time-warping parameters are de-quantized by a block 501, which is a lossless decoding block.

A dynamic time-warping reconstruction block 502 reconstructs the time-warping parameters according to the M-S flag.

When the M-S flag is 1, one set of time-warping parameters is generated. Otherwise two sets of time-warping parameters are generated from the dynamic time-warping parameters. The processes of the generation of the time-warping parameters are the same as in the second embodiment.

In a time-warping block 503, different time-warping parameters are applied to the time-warped left signal and the time-warped right signal when the M-S flag is 1. Otherwise the same time-warping parameters are applied to the time-warped stereo audio signals.

(Eighth Embodiment)

Figure 6:
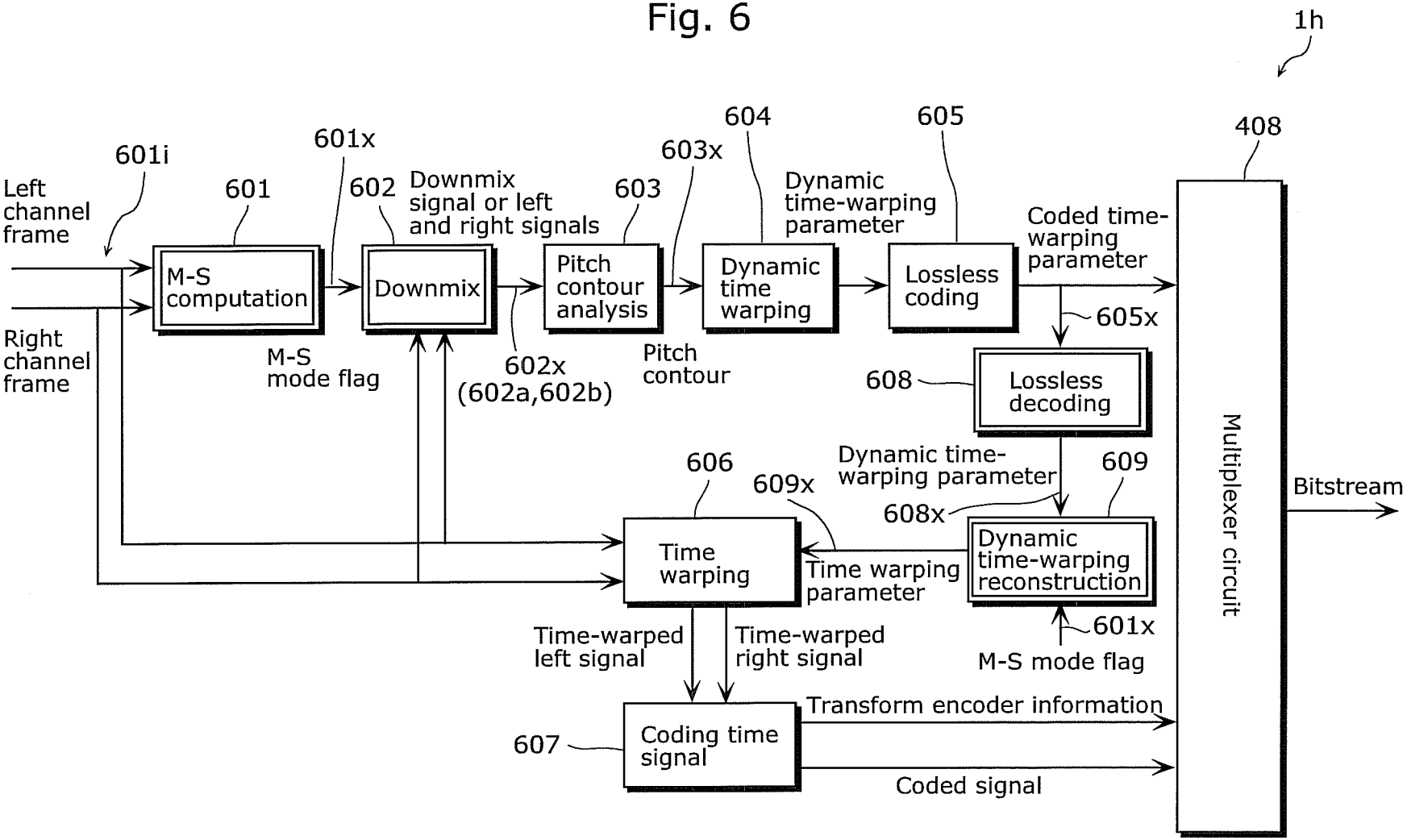
FIG. 6 is a block diagram of an encoder in which a modification of dynamic time warping using an M-S mode is performed.

FIG. 6 is a block diagram of an encoder in which modified dynamic time warping in M-S mode is applied.

The eighth embodiment is a modification of the fourth embodiment as shown in FIG. 6 in which accuracy of the time warping by the encoder is increased.

The modification is the same as the modification in the third embodiment.

A lossless coding block 608 and a dynamic time-warping reconstruction block 609 are added to the coding structure. The purpose is to allow the encoder to use the same time-warping parameters as the decoder. The operations of blocks 608 and 609 are the same as the blocks 501 and 502 in FIG. 5.

(Ninth Embodiment)

In the ninth embodiment, an encoding device includes a closed loop dynamic time-warping unit.

Figure 7:
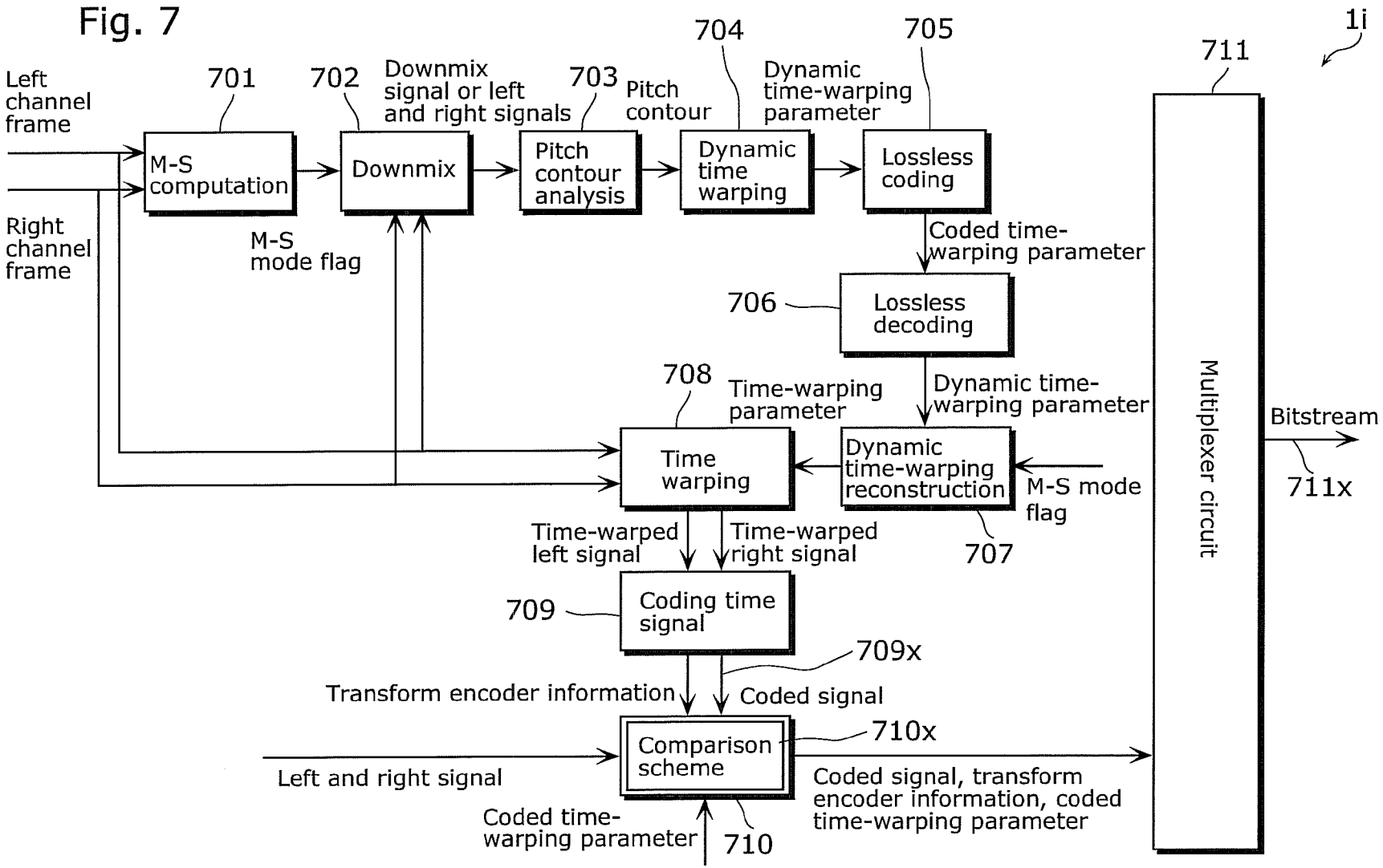
FIG. 7 is a block diagram of an encoder in which closed-loop dynamic time warping is performed.

FIG. 7 illustrates the encoding device according to the ninth embodiment.

The configuration according to the ninth embodiment is based on the configuration according to the eighth embodiment, but a comparison scheme (a comparison scheme 710) is added. Before sending a coded signal and time-warping parameters to a multiplexer 711 in FIG. 7, the coded signal is checked using the comparison scheme 710. A determination is made as to whether sound quality is improved overall after decoding time warping.

There are different kinds of comparison schemes. One example is to compare an SNR of the decoded signal with an SNR of the original signal.

In the first part of the comparison, a coded time-warped signal is decoded by a transform decoder. By using the same time-warping parameters as in a block 708 in FIG. 7, time warping is applied to the time-warped signal obtained by the decoding. An unwarped signal is thus generated. An SNRi is calculated by comparing the unwarped signal to the original signal.

In the second part of the comparison, another coded signal is generated without time warping. The coded signal is decoded by the same transform decoder, and an $SNR_2$ is calculated by comparing the signal obtained by the decoding to the original signal.

In the third part of the comparison, the determination is made by comparing the $SNR_1$ and the $SNR_2$. When $SNR_1 > SNR_2$, applying the time warping is selected, and the coded signal in the first part, the transform encoder information, and the coded time-warping parameters are sent to the decoder. Otherwise applying no time warping is selected, and the coded signal in the second part and the transform encoder information are sent to the decoder.

In another comparison scheme, bit consumption is compared instead of SNRs.

In summary, the time-warping technique is used to compensate effects of pitch change in an audio coding system. Proposed herein is a dynamic time-warping scheme which improves efficiency in time warping. In the time-warping scheme according to the present invention, a pitch contour is modified based on an analysis of a harmonic structure; sound quality is improved by taking into account a harmonic structure during time warping. In addition, in the dynamic time-warping scheme, effectiveness of the time warping is evaluated by comparing the harmonic structures before and after time warping, and a determination as to whether or not the time warping should be applied to the current audio frame is made based on the comparison. It eliminates inaccuracy due to inaccurate pitch contour information. The dynamic time warping also provides a more efficient method of coding time-warping parameters and improves sound quality and coding efficiency using M-S mode information obtained by transform coding.

The encoding device 1 and the decoding device 2 (the signal processing system 2S in FIG. 1, FIG. 2, FIG. 20, and FIG. 21) may be configured as thus far described. In an aspect of the present invention, these devices may operate in the manner as described below. In other words, these devices may operate by performing part (or all) of the above processes in the same (or a similar) manner as described below.

Specifically, the encoding device 1 may perform the following processes.

When a sound signal 101*i* (see FIG. 1 and the signal 811 in FIG. 11) is given, for example, a signal 104*x* (see FIG. 1 and a signal 812 in FIG. 11) may be generated (by the time-warping unit 104 or in Step S104 in FIG. 21) from the signal 101*i* by shifting the pitch (the pitch 822 in FIG. 15) of the signal 101*i* to a reference pitch (the reference pitch 82*r* in FIG. 15).

A pitch may be thus shifted to a reference pitch or a pitch other than the reference pitch such as a harmonic of the reference pitch (for example, see Eq. 2).

The signal 101*i* (and the signal 104*x*) may be specifically a signal of one of multiple channels such as stereo 2 channels, 5.1 channels, or 7.1 channels.

Figure 16:
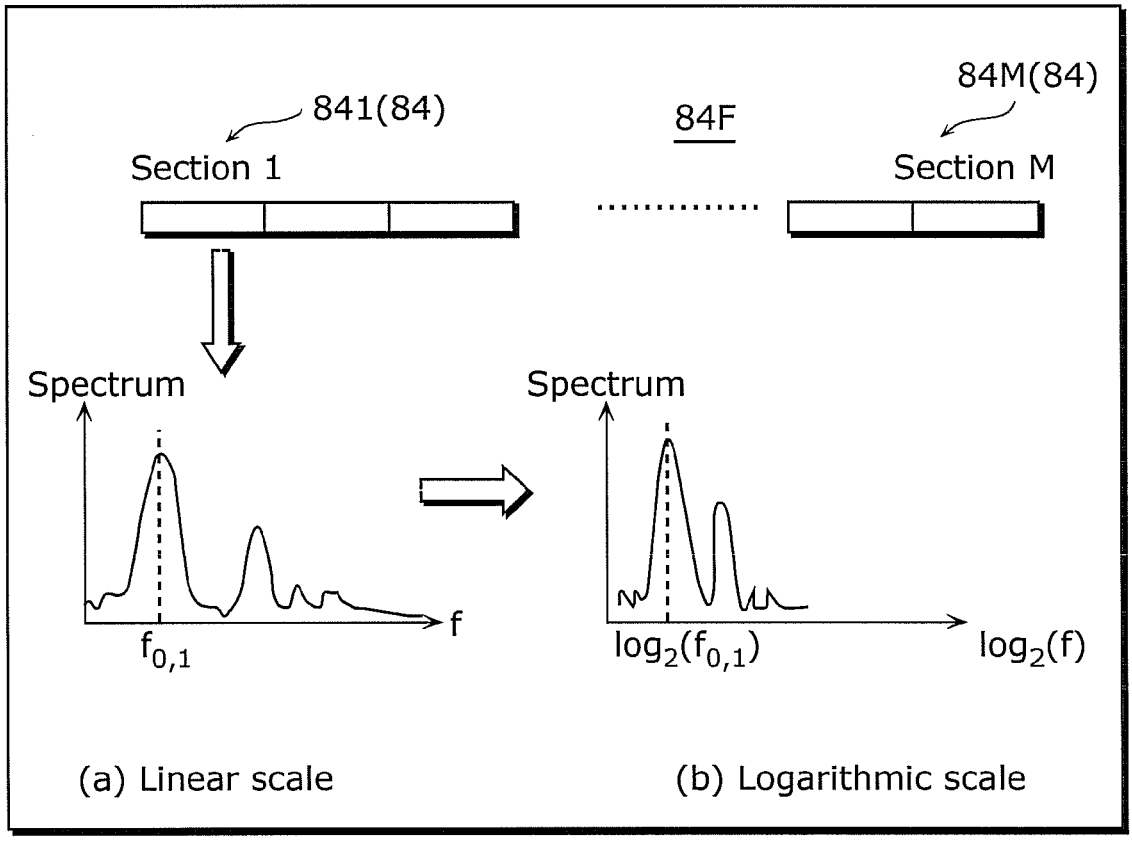
FIG. 16 illustrates a spectrum plotted on a logarithmic scale.

More specifically, the signal 101*i* may be a signal of one or some of sections 84 (for example, the M sections 84 (the sections 841 to 84M) included in the frame 84F in FIG. 16).

The value M in FIG. 16 is, for example, 16.

The above reference pitch (the reference pitch 82*r*) is, for example, a pitch such that coding of the signal 104*x* obtained by the shifting to the reference pitch is more appropriate than coding of the signal 101*i*.

Here, "more appropriate" means, for example, that the data amount of the signal 105*x* (FIG. 1) obtained by the coding the signal 104*x* having a pitch after the shifting is smaller than the data amount of a signal obtained by the coding of the signal 101*i* (with sound quality maintained). In other words, for one data, there is no loss of sound quality, and for the other data, sound quality is the same as the one data and the data amount is smaller than the amount of the one data.

The reference pitch of the current section (for example, a section 822*s*) is, for example, a pitch which is the same as a pitch to which a pitch of another section of the signal 101*i* (for example, a section 821*s* adjacent to the section 822*s* in FIG. 15) is shifted (the reference pitch 82*r*).

Then, the signal 104*x* (FIG. 1) obtained by the shifting may be coded into the signal 105*x* (by the transform encoder 105 or in Step S105).

In this configuration, the signal 104*x* obtained by the shifting is easier to code due to its spectrum. Such a signal easy to code may be coded into data in a smaller amount than a signal without being shifted (the first signal 101*i*), for the same sound quality.

Because of this, instead of directly coding the first signal 101*i* without being shifted, the second signal 104*x* obtained by the shifting is coded into the third signal 105*x* which is smaller in amount than the signal obtained by direct coding of the first signal 101*i*. As a result, the third signal 105*x* in a smaller amount is used as a coded signal of sound represented by the first signal 101*i*.

On the other hand, parameters 102*x* (the dynamic time-warping parameters or the pitch parameters) which specifies the pitch of the signal 101*i* without being shifted (see the pitch 822 in FIG. 15) (by the pitch parameter generation unit 102 or in Step S102).

For example, a predetermined ratio (the pitch change ratio; see the ratio 88 (Tw_ratio) in FIG. 18) may be used as the calculated parameter 102*x* in the manner as described above. The calculated ratio (the ratios 88, the parameters 102*x*) specifies a pitch-shifted from a predetermined pitch by the ratio (for example, the pitch 822 shifted from the pitch 821 by the ratio 83 in FIG. 15).

More specifically, for example, the ratio 88 may be indirectly specified using data of an index specifying the ratio 88 (Tw_ratio_index in FIG. 18). Such data of an index may be calculated as the parameter 102*x*.

In FIG. 15, the position of the tip of the arrow denoted by the reference numeral 83 schematically indicates that the ratio denoted by the reference numeral 83 is the ratio between the pitch 821 and the pitch 822.

When the signal 105*x*, which is a coded sound signal, is decoded (by the decoding device 2, for example), a signal having a pitch specified by the calculated parameter 102*x* (the signal 203*x* having the pitch 822 in FIG. 2) may be generated from a signal obtained by decoding of the signal 105*x* (the signal 203*ib* obtained by decoding the signal 204*i* in FIG. 2) (or, referring to in FIG. 1, the signal 101*i* having a pitch specified by the calculated parameter 102*x* may be generated from the signal 104*x* obtained by decoding the signal 105*x* (through reverse-shifting)).

More specifically, the parameter 102*x* may be transmitted from the encoding device 1 to a decoding device (the decoding device 2) and the above process may be performed using the transmitted parameter 102*x* (see the signal 201*i* in FIG. 2).

In this configuration, it is ensured that the signal obtained by the decoding (the signal 203*x* in FIG. 2) has an appropriate pitch (the pitch 822).

In this manner, the signal processing system may be implemented using both sound data (the signal 104*x* and the signal 105*x* in FIG. 1 and the signal 203*ib* and the signal 204*i* in FIG. 2) and pitch data (the parameter 102*x* specifying a pitch).

However, there may be a case where reduction in the amount of the pitch data (the parameter 102*x* in FIG. 1 and the parameter 201 in FIG. 2) is desired more than reduction in the amount of the sound data by using a smaller amount of signals coded from the signal 101*i* (the signal 105*x* in FIG. 1) and to be decoded into the signal 203*i* (the signal 204*i* in FIG. 2).

In this case, for example, the calculated parameter 102*x* may be coded into the coded parameter 103*x* obtained by coding (see FIG. 1, and the parameter 201*i* in FIG. 2), which is smaller than the parameter 102*x* in amount, by the lossless coding block 103 or in Step S103 using lossless coding (such as the Huffman coding or arithmetic coding).

The data amount of the parameter 102*x* (the pitch data) may be thus reduced by (lossless) coding.

However, there is another available pitch of a section: a pitch of a section chronologically adjacent to the section for which the pitch is specified by the calculated parameter 102*x* (see FIG. 1, and the parameter 204*i* in FIG. 2). For example, referring to FIG. 15, the pitch 821 of a section 821*s* is available, which immediately precedes the section 822*s* for which the pitch 822 is specified.

The calculated parameter 102*x* may be a parameter specifying a ratio (Tw_ratio in FIG. 18) between the pitch specified by the parameter 102*x* and a pitch of an adjacent section (for example, the ratio 83 between the pitch 822 and the pitch 821 of the section 821*s*). Then, the calculated (specified) ratio is lossless coded, and data obtained by the lossless coding of the ratio may be used as the coded time-warping parameters (see the description above).

In other words, the calculated parameter 102*x* specifies a ratio (the ratio 83 in FIG. 15) corresponding to a change from one pitch (the pitch 821) to the other pitch (the pitch 822), which are adjacent to each other, so that the other pitch (the pitch 822) may be indirectly specified by the calculated parameter 102*x*.

Furthermore, the inventors found through experiments that, in relatively many cases, ratios 88*a*, which are relatively close to the ratio 88 of a change of a musical interval of zero cent (for example, the very ratio 88*x* of 1.0 in FIG. 18), occurs at a high frequency, and, on the other hand, ratios 88*b*, which are relatively far from the ratio 88*x* (for example, a ratio of 1.0293 in FIG. 18) occurs at a low frequency.

In other words, the inventors found that frequency of occurrence of each of the ratios 88 depends on difference from the ratio corresponding to a pitch difference of zero cent, that is, the ratio 88*x* (the frequency increases as the ratio becomes closer to the ratio 88$x$ which corresponds to a pitch difference of zero cent, and decreases as farther from the ratio 88$x$).

Thus, when the calculated ratio 88 (the parameter 102$x$) is a ratio relatively close to the ratio 88$x$ corresponding to the pitch difference of zero cent (the ratio 88$a$ in FIG. 18) and occurs at a relatively high frequency, the calculated ratio 88 (the parameter 102$x$) may be coded into a code of a relatively short length (bit length) (a code 90$a$ of a bit sequence, for example, a code of "0" having a length of one bit (see FIG. 18)).

On the other hand, when the calculated ratio 88 (the parameter 102$x$) is a ratio relatively far from the ratio 88$x$ corresponding to the pitch difference of zero cent and occurs at a relatively low frequency (the ratio 88$b$), the calculated ratio 88 (the parameter 102$x$) may be coded into a code of a relatively long length (a code 90$b$ of a bit sequence, for example, a code of "111110" having a length of six bits (see FIG. 18)).

In other words, the calculated ratio 88 (the parameter 102$x$, the ratio 88$a$ or the ratio 88$b$) may be variable-length coded so that the ratio 88 is coded into a variable-length code 90 (the code 90$a$ or 90$b$) having a length corresponding to frequency of occurrence of the ratio 88 depending on closeness to the ratio 88$x$ corresponding to the pitch difference of zero cent (difference from the ratio 88$x$).

Specifically, for example, a table 103$t$ (table data or a table 85; see FIG. 18, FIG. 20, and FIG. 1) may be provided in which ratios 88 (such as the ratios 88$a$ and 88$b$) are associated with respective appropriate variable-length codes 90 (such as the codes 90$a$ and 90$b$).

Figure 20:
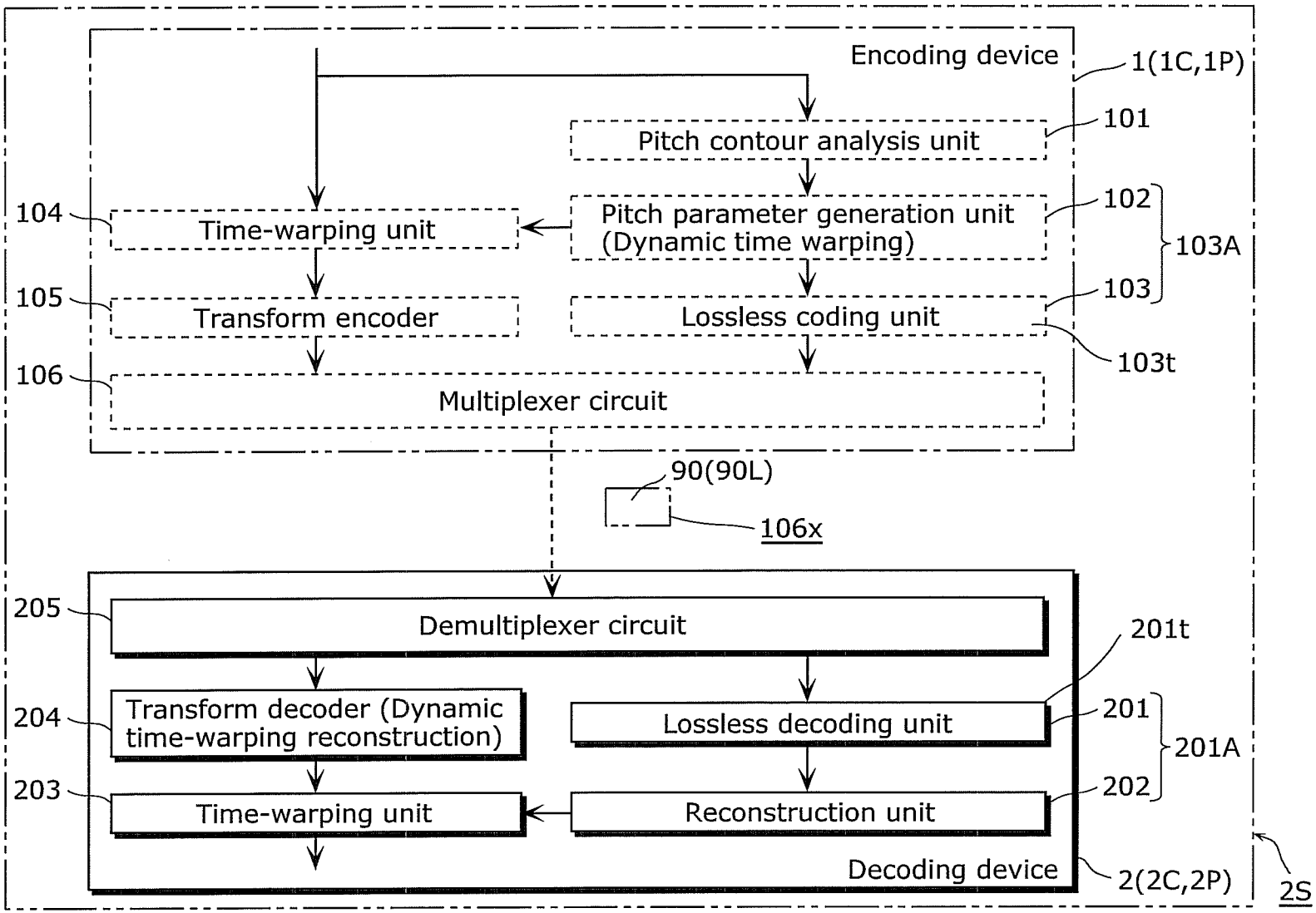
FIG. 20 illustrates an encoding device and a decoding device.

Specifically, the table 103$t$ may be stored in, for example, the lossless coding unit 103 (a first pitch processing unit 103A; see FIG. 1 and FIG. 20).

The variable-length coding may be performed by coding each of the calculated ratios 88 (the ratio 88$a$ or 88$b$, the parameter 102$x$ in FIG. 1) into a corresponding one of the variable-length codes 90 (the code 90$a$ or 90$b$, the parameter 103$x$ in FIG. 1) using the stored table 103$t$.

This operation reduces the data amount of the parameter 103$x$ (the code 90) obtained by the coding of pitches, and thus indirectly increases the amount of coded data to be used by the transform encoder, so that quality of coded sound may be improved.

In this configuration, the decoding device 2 (see FIG. 2, etc.) may perform the following processes.

The signal 204$i$ which is the coded signal of the sound signal 203$ib$ (the signal 104$x$ in FIG. 1) may be decoded into the signal 203$ib$ (the signal 104$x$) (by the transform decoder 204 or in Step S204). A method used by the transform decoder may be an orthogonal transform coding method such as MPEG-AAC (Moving Picture Experts Group-Advanced Audio Coding), an audio coding method such as ACELP (Algebraic Code Exited Linear Prediction), or a method other than them.

More specifically, the signal 204$i$ to be decoded is a signal 204$i$ (105$x$) obtained by coding the signal 2031B (the signal 104$x$) obtained by shifting, to the reference pitch (the reference pitch 82$r$), the pitch of the signal 203$x$ (the signal 101$i$) which has been generated from the sound signal 203$x$ (the signal 101$i$) before shifting.

In other words, the signal 204$i$ to be decoded may be, for example, the signal 105$x$ obtained by the coding by the encoding device 1.

More specifically, the signal 204$i$ to be coded may be included in coded data transmitted from the encoding device 1 to the decoding device 2 (the stream 106$x$ in FIG. 1 or the stream 205$i$ in FIG. 2), that is, a signal transmitted from the encoding device 1 to the decoding device 2.

Then, from the signal 203$ib$ obtained by decoding the signal 204$i$, the signal 203$x$ is generated by shifting (reverse-shifting) the reference pitch (the reference pitch 82$r$) of the signal 203$ib$ to the pitch before the shifting (the pitch 822) (by the time-warping unit 203 or in Step S203).

More specifically, the coded time-warping parameter 201$i$ is lossless-decoded so that the dynamic time-warping parameter 202$i$ is obtained. The obtained dynamic time-warping parameter 202$i$ is represented by the TW_Ratio_Index. Next, the time-warping parameter TW_Ratio is obtained using the obtained dynamic time-warping parameter 202$i$ and the table 103$t$ indicating the relation between the TW_Ratio_Index and the TW_Ratio. Then, acceding to the obtained TW_Ratio, the time-warping circuit (time-warping unit) 203 transforms (reverse-shifts) the signal 203$ib$ into the unwarped signal 203$x$ which has a pitch equivalent to the pitch before the shifting.

The pitch may be shifted (by the lossless decoding unit 201 or in the Step S201) to a pitch (the pitch 822) specified by the ratio 88 (the parameter 202$i$, the parameter 102$x$) obtained by decoding the parameter 201$i$ (the parameter 103$x$ in FIG. 1) obtained by coding the ratio 88 (the parameter 202$i$, the parameter 102$x$).

In this configuration, the pitch data may be reduced in amount to the data obtained by the coding (the parameter 201$i$, the parameter 103$x$).

As described above, the inventors found that among the ratios 88, the ratio 88$a$, which is close to the ratio 88$x$ corresponding to the pitch difference of zero cent, occurred at a high frequency and the ratio 88$b$, which is far from the ratio 88$x$ corresponding to the pitch difference of zero cent, occurred at a low frequency.

According to the present invention, the relatively short code 90$a$ may be decoded into the ratio 88$a$, which is close to the ratio 88$x$ corresponding to the pitch difference of zero cent, and the relatively long code 90$b$ may be decoded into the ratio 88$b$, which is far from the ratio 88$x$ corresponding to the pitch difference of zero cent.

In other words, such codes may be decoded according to the frequency of the occurrence depending on closeness to the ratio 88$x$ corresponding to the pitch difference of zero cent (that is, the codes may be decoded in a manner corresponding to variable-length coding based on the frequency of the occurrence).

To put it in the other way around, a code 90 (FIG. 18) of the parameter 201$i$ to be decoded is the shorter code 90$a$ when the code 90 is a code of the ratio 88$a$, which is close to the ratio 88$x$ corresponding to the pitch difference of zero cent, and a code 90 (FIG. 18) of the parameter 201$i$ to be decoded is the longer code 90$b$ when the code 90 is a code of the ratio 88$b$, which is far from the ratio 88$x$ corresponding to the pitch difference of zero cent.

Thus, the shorter code 90$a$ is decoded into the ratio 88$a$, which is close to the ratio 88$x$ corresponding to the pitch difference of zero cent, and the longer code 90$b$ may be decoded into the ratio 88$b$, which is far from the ratio 88$x$ corresponding to the pitch difference of zero cent.

AS a result, the amount of the pitch data is further saved.

For example, a decode table 201$t$ (the table 85; see FIG. 18, FIG. 2, FIG. 20) corresponding to the table 103$t$ (the table 85; see FIG. 18) is previously stored.

Specifically, the table 201$t$ may be stored in, for example, the lossless decoding unit 201 (a second pitch processing unit 201A; see FIG. 2, FIG. 20, etc).

Then, the variable-length code 90 (the coded parameter 201*i*) is decoded into a corresponding ratio 88 (the parameter 202*i*) using the stored table 201*t*, so that the decoding may be appropriately performed.

It is to be noted that, in a known technique, pitch data (see the ratio 88 in FIG. 18 and the parameter in FIG. 1 (see also the parameter 202 in FIG. 2, etc.)) is coded into a fixed-length code (see the fixed-length codes 91 (the codes 91*a* and 91*b*) having a three-bit length in FIG. 19).

Then, for example, a frame 84F is segmented into 16 sections 84 (sections 841 to 84M, where M=16) as described above for FIG. 16.

Figure 22:
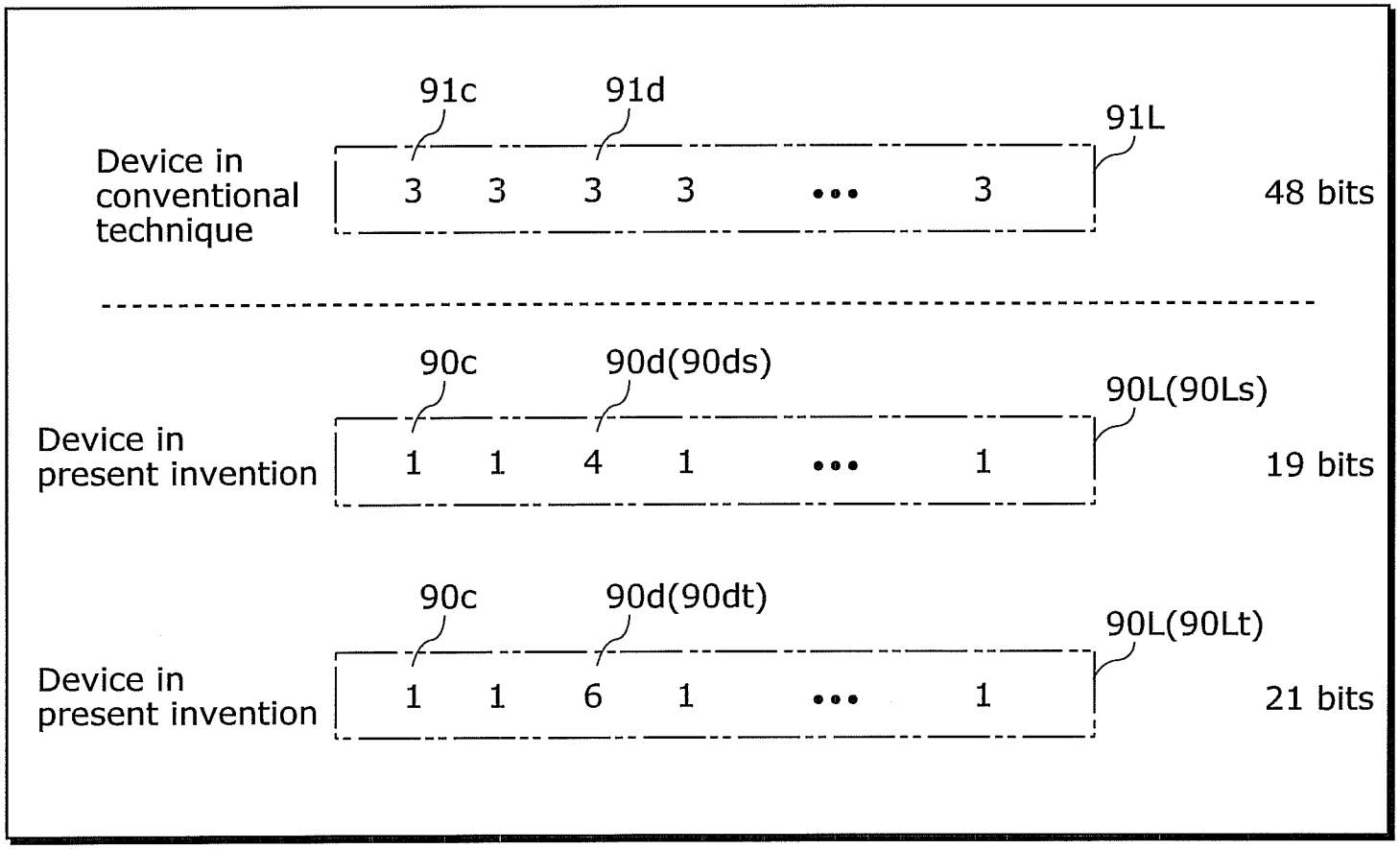
FIG. 22 illustrates data in a conventional technique and data in a device according to the present invention.

Therefore, in the conventional technique, the data 91L (see the first row and second column of FIG. 22) to be transmitted as data of the frame 84F includes, for example, 16 fixed-length codes 91 (including the fixed-length code 91*c* and 91*d* in FIG. 22) corresponding to the 16 sections 84 of the frame 84F, which makes a relatively large data of 48 bits=3 bits×16 codes (see the first row and third column in FIG. 22).

Compared to this, in the encoding device 1 and the decoding device 2 according to the embodiments of the present invention, the data 90L transmitted as data of the frame 84F (see the second row and the third row of FIG. 22) includes 15 codes 90*c* having a length of one bit, which is indicated by the number "1" in FIG. 22.

The data 90L according to the embodiments of the present invention also includes, for example, a code 90*d* (a code 90*dt* in the data 90Lt) having a length of six bits indicated by the number "6" as shown in FIG. 22 (or in the case of the data 90Ls, a code 90*d* (a code 90*ds* in the data 90Ls) having a length of four bits indicated by the number "4").

In this manner, the data 90L according to the embodiments of the present invention includes such many codes 90*c* (for example, 15 in the example shown FIG. 22). The codes 90*c* (each corresponding to the code 90*a* in FIG. 18) occur at a high frequency (for example, 15 out of 16 in FIG. 22) and have a shorter length (for example, the length of one bit of the codes 90*c* in FIG. 22, and the length of one bit of the code 90*a* "0" in FIG. 18).

On the other hand, the data 90L includes fewer (or the only one as exemplified in FIG. 22) codes 90*d* (each corresponding to the code 90*b* in FIG. 18) which has a longer length (for example, the length of six bits (four bits for the data 90Ls) in FIG. 22, and the length of six bits of the code 90*b* "111110" in FIG. 18).

In other words, as illustrated, the data 90L in the system according to the embodiments of the present invention is in a relatively small amount of, for example, 1×15+6×1=21 bits (the data 90Lt in the third row) or 1×15+4×1=19 bits (the data 90Ls in the second row).

Therefore, for example, the system according to the present invention will contribute to reduction of data amount from 48 bits of the data 91L (shown in the first row of FIG. 22) in the conventional technique to that of the data 90L; for example, a reduction of 27 bits from 48 bits to 21 bits (the data 90Lt in the third row of FIG. 22), or a reduction of 29 bits from 48 bits to 19 bits (the data 90Ls in the second row of FIG. 22).

It is to be noted that such amount of reduction (27 bits and 29 bits) are of merely example figures on the basis of theoretical calculation. The above principle of reduction may be thus used for approximating to the reductions (27 bits and 29 bits) or a reduction of any amount, even a relatively small one.

In this manner, according to the embodiments of the present invention, the data amount may be reduced by relatively large bits (for example, 27 bits or 29 bits as exemplified above).

In addition, the system according to the embodiments of the present invention may operate in the manner as described below.

FIG. 12 illustrates a musical interval 90*j* of 100 cents which composes a semitone (one cent is a twelve-hundredth of one octave). A musical interval of one cent is a hundredth of a musical interval of a semitone 90*j* (see also "100*c*" in FIG. 12).

Each of the numbers in the first column (Cent) in the table shown in FIG. 18 indicates how many times the musical interval between two pitches (for example, see the pitches 821 and 822 in FIG. 15) apart from each other by the ratio 88 in the corresponding row is as large as one cent, that is, the musical interval of the ratio 88 in the row in cent.

For example, referring to the third row of the table in FIG. 18 (the row having a code of "111100"), a musical interval between pitches by the ratio 88 of 1.0293 (see the ratio 83 in FIG. 15) is 50 cents.

A range 861 (one part of the range 86*a* in FIG. 18) is a range in which musical intervals for the ratios 88 (1.0293 and 1.0416) are larger than the musical interval of zero cent for the ratio 88*x* (in the eighth row in FIG. 18) by 42 cents or more (in other words, a range in which the ratios 88 are larger than the ratio 88*x* and the absolute difference between the pitches is 42 cents or larger).

On the other hand, the range 862 (the other part of the range 86*a*) is a range in which musical intervals for the ratios 88 (0.9772, 0.9715, 0.9604) are smaller than the musical interval of zero cent for the ratio 88*x* by 42 cents or more (or a range in which the ratios 88 are smaller than the ratio 88*x* and the absolute difference between the pitches is 42 cents or larger).

In other words, the range 86*a* composed of the range 861 and the range 862 is a range in which the absolute difference between pitches is 42 cents or more greater than the pitch difference of zero cent for which the ratio between pitches is the ratio 88*x* (see the eighth row), that is, a range in which the ratios 88 are different from the ratio 88*x* by 42 cents or more in corresponding pitches.

On the other hand, the range 87 is a range in which the absolute difference of the ratios 88 from the ratio 88*x*, in cents, is smaller than 42 cents.

The range 87 will be further detailed later.

As shown in FIG. 18, the ratio 88*a* (the ratio 83*a* in FIG. 15) belongs to the range 87 in which the pitch differences are smaller than 42 cents, and the ratio 88*b* (the ratio 83*b* in FIG. 15) belongs to the range 86*a* in which the pitch differences are 42 cents or larger.

The two pitches (see the pitches 821 and 822 in FIG. 15) which make the ratio 83 (see FIG. 15, or the ratio 88 in FIG. 18) has a relatively small pitch difference when the ratio 83 is the ratio 83*a* (the ratio 88*a*) within the range 87 of pitch differences smaller than 42 cents, and has a relatively large pitch difference when the ratio 83 is the ratio 83*b* (the ratio 88*b*) within the range 86*a* in which the pitch differences are 42 cents or larger.

The experiments conducted by the inventors showed that not only the ratio 88*a* within the range 87 of the pitch differences smaller than 42 cents but also the ratio 88*b* within the range 87 in which the differences are 42 cents or larger occurred when the two pitches having such a large pitch difference occurred (see the pitches 821 and 822).

The ratio 88*a* is, for example, a ratio 88*a* relatively close to the ratio 88*x* corresponding to a musical interval of a zero cent (Tw_ratio of 1, or the very ratio 88*x* in FIG. 18).

The ratio 88*b* is relatively far from the ratio 88*x*.

Therefore, as described above, the code 90*a* (the code "0" of a length of one bit) corresponding to the ratio 88*a* is shorter than the code 90*b* (the code "111100") corresponding to the ratio 88*b*.

Here, for example, when a ratio 88*a* within a range 87 is calculated as a ratio 88 of the signal 101*i* (see FIG. 1), a code 90*a* (the parameter 103*x* in FIG. 1) corresponding to the calculated ratio 88*a* may be generated (by the encoding device 1), and the generated code 90*a* may be decoded into the ratio 88*a* (the parameter 202*i* in FIG. 2) (by the decoding device 2), which is followed by the processes described above.

Specifically, when the ratio 88 is a ratio 88*a* within the range 87, the processes are performed and the shifting is done, and thereby the amount of the sound data (see the signal 105*x* in FIG. 1 and the signal 204*i* in FIG. 2) is reduced.

Then, even when the ratio 88 of the signal 101*i* is a ratio 88*b* within the range 86*a*, a code 90*b* corresponding to the ratio 88*b* may be generated and the generated code 90*b* may be decoded into the ratio 88*b*, which is followed by the processes described above. The amount of the sound data (see the signal 105*x* in FIG. 1 and the signal 204*i* in FIG. 2) is thereby reduced.

In this manner, the process is performed even when a calculated ratio 88 is a ratio 88*b* within the range 86, in other words, a musical interval for the ratio 83 between the two pitches (the pitches 822 and 821) is equal to or larger than 42 cents, so that the amount of the sound data is reduced. This ensures reduction in the amount of sound data.

In other words, the amount of sound data is reduced not only when the ratio 83 (FIG. 15) is a ratio 83*a* smaller than the ratio corresponding to a pitch difference of 42 cents and a change between two pitches (see the pitches 822 and 821 in FIG. 15) is small but also when the ratio 83 is a ratio 83*b* equal to or greater than a ratio corresponding to a pitch difference of 42 cents and a change between two pitches is large. Thus, this ensures reduction in the amount of sound data regardless of the magnitude of a change between pitches (see the pitches 822 and 821 in FIG. 15).

Compared to this, in the conventional technique (see FIG. 19), the data amount is reduced only when the ratio 89 corresponding to a pitch difference between two pitches (the pitches 822 and 821) is within the range 87 where the musical intervals are smaller than 42 cents. In this case, reduction in data amount is not always ensured.

Thus, the system according to the present invention ensures reduction in data amount and is outstandingly innovative in comparison with the conventional technique (FIG. 19).

In this manner, in the embodiments of the present invention, the range for which an appropriate process is expanded from the relatively narrow range (the range composed only of the range 87) to the wider range (the range 86 composed not only of the range 87 but also of the range 86*a*).

The range 86 is an example of such a widened range.

As far as the inventors currently know, the range for which the appropriate process is performed (the range 87) in the conventional techniques is a range of the ratios smaller than 42 cents (see the ratios 88).

In addition, for example, the operation and configuration described below are also possible in the aspect as follows. In the aspect, there are positions 704*p* and 704*q* in a frame to be coded (see FIG. 9). At the position 704*p* (which is a pitch change position, see FIG. 9), the ratio 83*p* (see FIG. 9) between two pitches (see the pitches 822 and 821 in FIG. 15) is not (close to) the ratio 90*x* for the musical interval of zero cent (see FIG. 18). At the position 704*q* (which is not a pitch change position, see FIG. 9), the ratio between two pitches 83*q* (see FIG. 9) is (close to) the ratio 90*x* for the musical interval of zero cent. In this case, for example, the encoding device may be configured to memory the position which is a pitch change position (704*p* in FIG. 9) and the position which is not a pitch change position (704*q* in FIG. 9) in the frame to be coded (in other words, the encoding device stores vectors C, 102*m* in FIG. 9), and to transmit, to the decoding device, the information on the positions and (the vectors C, 102*m*) and TW_Ratio or TW_Ratio_Index of the position which is a pitch change position (704*p*). By doing this, TW_Ratio (or TW_Ratio_Index) of only the position which is a pitch change position is transmitted, so that encoding device and the decoding device may be configured for the requisite minimum amount of communication data (the amount of data to be coded).

Then, as noted above, the inventors found that when positions 704*x* includes positions 704*p* which are pitch change positions and positions 704*q* which are not pitch change positions, many of the positions 704*x* are the positions 704*q* which are not a pitch change position and a few of the positions 704*x* are the positions 704*p* which are pitch change positions.

The parameters 102*x* (see FIG. 1 and the parameter 202*i* in FIG. 2) may include, for example, the data 102*m* (see FIG. 9) specifying the positions 704*p* which are pitch change positions and (data specifying) the ratio 83*p* at the position 704*p* specified by the data 102*m*.

The parameters 102*x* may specify, as the ratios 83*p* included in the parameters 102*x* (or specified by the data), the ratios for the position 704*p* specified by the data 102*m* included in the parameters 102*x*.

On the other hand, the parameters 102*x* may specify, as the ratios 83*q* for the positions 704*q* which are not pitch change positions, for example, as the ratio 90*x* for a musical interval of zero cent (FIG. 18), the ratios for positions other than the positions 704*p* specified by the data 102*m* included in the parameters 102*x* (that is, the ratios for the positions 704*q* which are not pitch change positions).

With this, the ratios (the ratios 83*p* and 83*q*) at the positions (the positions 704*p* and 704*q*) are still specified and the parameters 102*x* include not the data of positions which are not pitch change positions but only the data of the ratios 83*p* for the positions which are pitch change positions. Thus, data of many positions (the positions 704*q* which are not pitch change positions) is not included in the parameters 102*x*, so that the amount of the pitch data (the parameters 102*x* and 103*x* in FIG. 1, the parameters 204*i* and 203*ib* in FIG. 2) is further reduced.

Here disclosed is the format (the table 85 in FIG. 18) of codes (the variable-length code 90, data 90L (see FIG. 20, FIG. 22)) for coding the pitch (the pitch 822 and the ratio for the pitch 822) of the signal 204*i* (the stream 205*i*) to be input into the decoding device 2.

In the disclosed format, the code of the ratio 88*a* relatively close to the ratio 88*x* corresponding to the pitch difference of zero cent (the variable-length code 90, the code 90*a*) is the code 90*a* ("0") having a shorter length (a length of one bit), and, on the other hand, the code of the ratio 88*b* relatively far from the ratio 88*x* corresponding to the pitch difference of zero cent (the variable-length code 90, the code 90*b*) is the code 90*b* ("111100") having a longer length (a length of six bits).

Then disclosed is the process (procedure) S2 (see FIG. 21) performed on the input code in the format (the variable-length code 90, the code 90L) by the decoding device 2.

Through the procedure (the process S2) on the code in the format (see FIG. 18), the amount of the pitch data (the parameters 103$x$ and 203$x$) is reduced in the manner described above. For example, referring to FIG. 22, the amount of the pitch data is reduced from the 48 bits in the first row and third column to 21 bits in the second row and third column (or to 19 bits in the third row and third column).

Furthermore, for example, the format and the procedure may be a standard specified in specifications so that the techniques according to the present invention are widely used.

Thus, the amount of pitch data is reduced in such many situations that the techniques contribute more greatly to development of industry.

In the techniques according to the present invention, the configurations (such as the lossless coding unit 103) are used in combination to produce a synergistic effect. Compared to this, in the known conventional techniques (shown in FIG. 13, FIG. 14, FIG. 19, and other techniques), all or part of the configurations according to the present invention are not present so that such a synergistic effect is not produced.

In this respect, the techniques according to the present invention are innovative in comparison with the conventional techniques.

(All or) part of the encoding device 1 may be an integrated circuit having one or more of the functions of the encoding device 1 (for example, see an integrated circuit 1C in FIG. 20). Furthermore, a computer program may be built which causes a computer to perform one or more of the functions of the encoding device 1 (see a program 1P).

Similarly, an integrated circuit (see an integrated circuit 2C) or a computer program (see a program 2P) may be built which has the functions of the decoding device 2.

The computer programs may be recorded on a storage medium or built as data structures.

The technical elements disclosed in the different embodiments or different parts in the above description may be adaptively combined for use. Therefore, the embodiments in which the technical elements are combined are also disclosed herein.

In specific details, the embodiments may be modified in various manners. For example, the embodiments may be improved in the details, or modified by those skilled in the art when implemented.

Figure 21:
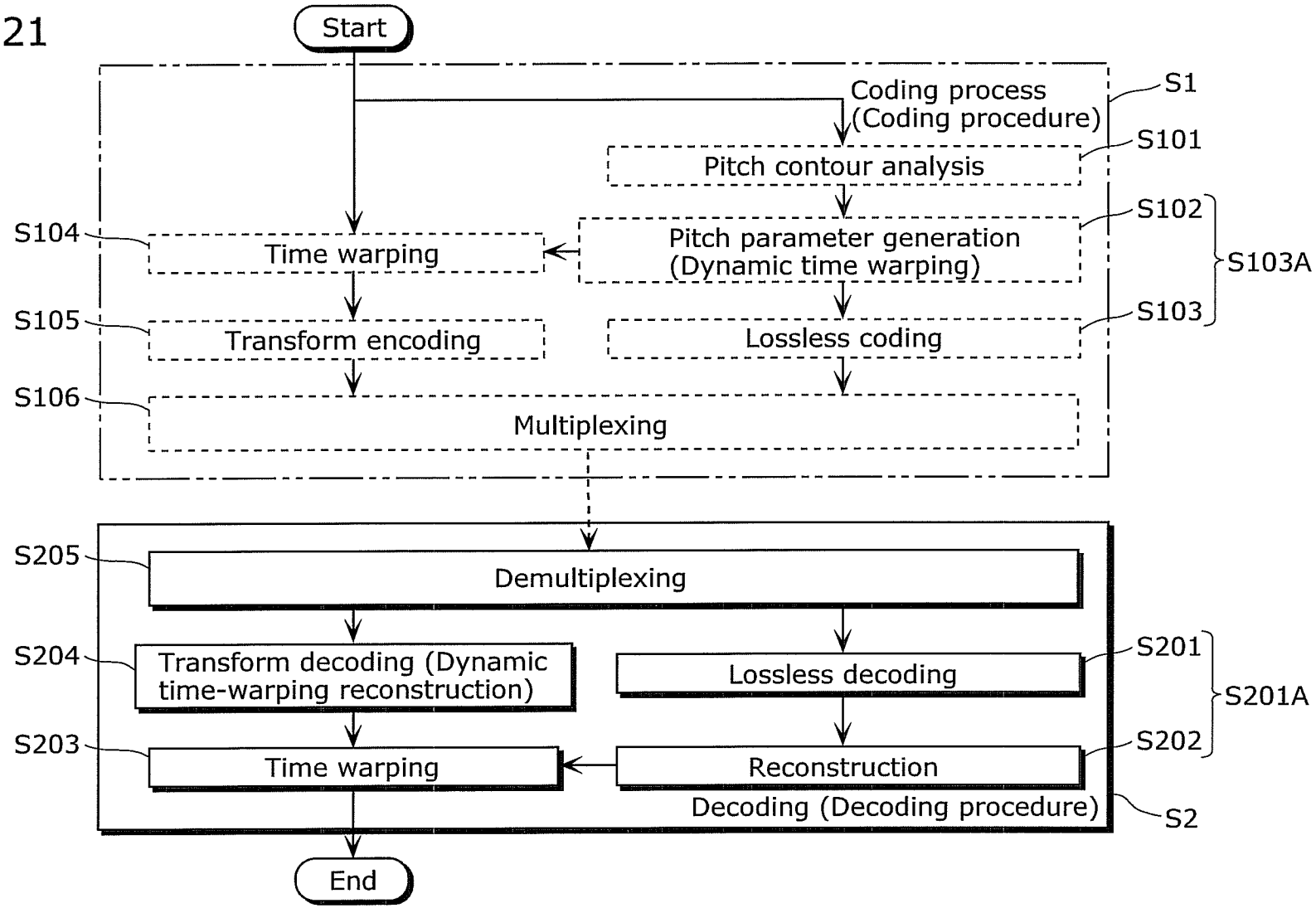
FIG. 21 illustrates a process flowchart.

The order of the steps shown in FIG. 21 (Steps 101 to S104, and so on) may be modified as far as an appropriate operation is possible. For example, Step S101 may be performed either before or after Step S104, or they may be performed simultaneously.

There are various conceivable ranges which may be used in the processes. In the present invention, the ranges (the ranges 86 and 87) of the pitch change ratios (the ratios 88 in FIG. 18 and the ratios 89 in FIG. 19) are selected from such ranges that the narrower range (the range 87 in the conventional techniques) is expanded to a wider range (the range 86). Such selection of the ranges according to the present invention is not easily conceived.

The devices may be also implemented in the manners as described below.

For example, the decoding device (the decoding device 2) may use position information (for example, data 102$m$ in FIG. 9) specifying positions where pitch changes (for example, the position 704$p$ in FIG. 9) among the positions in a frame (see the positions 841 to 84M in the frame 84 in FIG. 16) such that, in the bitstream received by the decoding device (see the bitstreams 106$x$, 205$i$, etc.), signals may be time-warped only at the positions where pitch changes by the audio signal reconstructor (the time-warping block (the time-warping unit) 203)) but not at the other positions (the position 704$q$).

Furthermore, the pitch parameter generator (the dynamic time-warping block 102) included in the encoding device may generate, based on the detected pitch contour information (the information 101$x$), the pitch parameters (the parameters 102$x$; for example, two pitch parameters 102$x$ of a first pitch parameter 102$x$ specifying a pitch change position and a second pitch parameter 102$x$ specifying a pitch change ratio) including a pitch change position (for example, see the position 704$p$ of the data 102$m$ in FIG. 9) and the pitch change ratios (see the ratio 83$p$).

In other words, for example, among the positions, data of pitch change ratios is processed only for pitch change positions but not for other positions.

As described above, the number of positions which are pitch change positions are small and the number of the other positions is large.

Therefore, if only the data of a small number of the positions (pitch change positions) is processed, the amount of data to be processed is saved.

Furthermore, as in the encoding device le shown in FIG. 3, the encoding device may further include a pitch contour reconstructor (the dynamic time-warping reconstruction block 307 in FIG. 3).

Specifically, the encoding device (the encoding device 1$e$ including the pitch contour analysis unit 301 to the multiplexer circuit 308) may further include: a first decoder (the lossless decoding block 306) which generates decoded pitch parameters (the parameters 306$x$) including decoded pitch change positions (for example, see the position 704$p$ in FIG. 9) and decoded pitch change ratios (see the ratio 83$p$) from the coded pitch parameters (the parameters 303$x$ in FIG. 3 (the parameters 103$x$)) output from the first encoder (the lossless encoding device 303 in FIG. 3 (the lossless encoding unit 103 in FIG. 1)); and a pitch contour reconstructor (the dynamic time-warping reconstruction block 307) which reconstructs the pitch contour information (the information 307$x$ (see the information 301$x$)) according to the generated decoded pitch parameters (the parameters 306$x$), wherein the pitch shifter (the time-warping block 304) shifts pitch frequency (the pitch 822 in FIG. 15) of the input audio signal (the signal 301$i$) according to the reconstructed pitch contour information (the information 307$x$).

With this, for example, reconstructed information 307$x$, which is the same information as reconstructed and used in the decoding device 2, is used for the shifting, so that the shifting may be performed using more appropriate (accurate) information.

Furthermore, the encoding device (the encoding device if including the M-S computation unit 401 to the multiplexer circuit 408) may further include: an M-S mode selector (the M-S computation block (the M-S computation unit) 401) which checks whether or not a middle and side stereo mode (M-S stereo mode) is to be activated for each audio frame of the input stereo audio signals (the signals 401$i$ in FIG. 4) and generates a flag (the flag 401$x$) indicating whether or not the M-S stereo mode is to be activated for the audio frame; and a downmixer (the downmix block 402) which downmixes the input stereo audio signals (the signals 401$i$) according the generated flag (the flag 401$x$), wherein the pitch detector (the pitch contour analysis block 403) detects, according to the flag (the flag 401$x$), pitch contour information of a downmixed signal (the signal 402$a$) obtained by the downmixing of the input stereo audio signals (the signal 401$i$) or pitch contour information (the information 403$x$) of the input stereo audio signals (the signal 402$b$), and the pitch shifter (the time-warping block 406) shifts pitch frequency of the input stereo audio signals or pitch frequency (see the pitch 822 in FIG. 15) of the downmixed signal (the signal 402*x* (the signal 402*a* or 402*b*)) according to the pitch contour information (the information 403*x*) and the flag (the flag 401*x*).

In other words, for example, a flag is thus generated and the process is performed according to the flag.

In this configuration, even though the M-S stereo mode is sometimes activated and sometimes not, the processes are appropriately performed according to the generated flag even without a user's operation indicating whether or not the M-S stereo mode is activated. This saves the user's trouble of operations, and thus the operation is simplified.

Furthermore, the encoding device (the encoding device 1*h* including the M-S computation unit 601 to the multiplexer circuit 408) may further include: an M-S mode selector (the M-S computation block 601) which determines, according to the input stereo audio signals (the signals 601*i* in FIG. 6), whether or not a middle and side stereo mode (M-S stereo mode) is to be activated and generates a flag (a flag 601*x*) indicating whether or not the M-S stereo mode is to be activated; a downmixer (the downmix block 602) which downmixes the input stereo audio signals (the signals 601*i*) according the generated flag (the flag 601*x*), a first decoder (the lossless decoding block 608); and a pitch contour reconstructor (the dynamic time-warping reconstruction block 609), wherein the pitch detector detects (the pitch contour analysis block 603), according to the flag (the flag 601*x*), pitch contour information (the information 603*x*) of a downmixed signal (the signal 601*a*) obtained by the downmixing of the input stereo audio signals (the signals 601*i*) or pitch contour information (the information 603*x*) of the input stereo audio signals (the signal 602*b*), the first decoder (the lossless decoding block 608) generates decoded pitch parameters (the parameters 608*x*) including decoded pitch change positions (for example, see the position 704*p* in FIG. 8) and decoded pitch change ratios (for example, see the ratio 83*p*) from the coded pitch parameters (the parameters 605*x*) output from the first encoder (the lossless coding block 605), the pitch contour reconstructor (the dynamic time-warping reconstruction block 609) reconstructs the pitch contour information (the information 609*x* (see the information 603*x*)) according to the generated decoded pitch parameters (the parameters 608*x*) and the flag (the flag 601*x*); the pitch shifter (the time-warping block 606) shifts pitch frequency of the input stereo audio signals or the downmixed signal (the signal 602*x* (the signal 602*a* or the signal 602*b*)) according to the reconstructed pitch contour information (the signal 609*x*).

In this configuration, the shifting is performed using the same information as the information to be used in the decoding device 2, so that the shifting is performed using the information which is more appropriates and operation is simplified at the same time.

Furthermore, the encoding device (the encoding device 1*i* including the M-S computation unit 701 to the multiplexer circuit 711) may further include a comparison unit (the comparison unit, the comparison scheme 710) configured to determine whether or not to use the pitch shifter (the time-warping block 708 in FIG. 7), wherein the multiplexer (the multiplexer block 711) combines coded pitch parameters (the parameters 710*x*) output from the comparison unit and coded data (the signal 709*x*) to generate the bitstream (the stream 711*x*).

In other words, for example, in the comparison scheme 710 a signal more appropriate for use by the decoding device (for example, the decoding device 2) may be selected from the generated third signal 709*x* (the third signal 105*x* in FIG. 1) and another signal. The "more appropriate signal" means, for example, a signal which has a higher signal-to-noise ratio (SNR) and less noise, or a signal in a smaller data amount.

The other signal may be, for example, a signal which is other than the third signal 709*x* and represents the same sound as the sound represented by the third signal 709*x*.

More specifically, the selection may be made on the basis of comparison of two SNRs calculated for the third signal 709*x* and for the other signal.

The SNR may be calculated for a signal (each of the third signal 709*x* and the other signal) by obtaining a value at which a difference of the signal and a signal before shifting (see the signal 101*i* in FIG. 1) is determined as noise of the signal (the third signal 709*x*, the other signal).

In this configuration, the other signal is used when the third signal 709*x* is less appropriate. Thus, use of an appropriate signal is always ensured.

Furthermore, the pitch parameter generator (for example, dynamic time-warping block 102 in FIG. 1) included in the encoding device (the encoding device 1) may modifies the pitch contour (the information 101*x*) based on a comparison between a first harmonic structure and a second harmonic structure and determines whether or not pitch shifting is to be applied, the first harmonic structure being a structure before the pitch shifting, and the second harmonic structure being a structure after the pitch shifting.

For example, application of pitch shift using the first pitch contour may be determined by not modifying the first pitch contour, and the application of pitch shift using the second pitch contour may be determined by modifying the first pitch contour to the second pitch contour.

The (data of) the harmonic structure may be data including values each indicating the amplitude of the corresponding one of the harmonics of the signal.

An evaluation value indicating the quality of the signal after the pitch shift may be calculated from the harmonic structure of the signal before the pitch shift and the harmonic structure of the signal after the pitch shift.

When the evaluation values indicate that the pitch shifting of the first pitch contour provides better quality than the pitch shifting of the second pitch contour, it may be determined that the first pitch contour is not modified. Otherwise it may be determined that the first pitch contour is modified.

In this configuration, the process is performed using the second pitch contour when the first pitch contour is inferior in quality, so that the quality of signals after pitch shifting is maintained high. Thus, high quality of signals is ensured.

On the other hand, the first decoder (the lossless decoding block 201 in FIG. 2) included in the decoding device (the decoding device 2*c*) according to any one of the embodiments of the present invention may generates, from the separated coded pitch parameter information (the parameters 201*i*), the decoded pitch parameters (the parameters 202*i*; for example, two parameters 202*i* of a first parameter 202*i* specifying pitch change positions and a second parameter 202*i* specifying the pitch change ratios) including pitch change positions (for example, see the position 704*p* in FIG. 9) and the pitch change ratios (for example, see the ratio 83*p*).

Furthermore, the decoding device (the decoding device 2*g* including the lossless decoding unit 501 to the demultiplexer circuit 506 in FIG. 5)

may decode the bitstream (the stream 506*i*) including the coded data (the signal 505*i* in FIG. 5) of a pitch-shifted audio signal (for example, the signal 503*ib*L in FIG. 5), and include an M-S mode detector (the M-S mode detection block 504), wherein the second decoder (the transform decoder block 505) decodes the separated coded data (the signal 505*i*) to generate the pitch-shifted stereo audio signals (for example, the signal503*ib*L) and M-S mode coding information (the information 504*i*), the M-S mode detector (the M-S mode detection block504) detects, according to the M-S mode coding information (the information 504*i*), whether the M-S mode is activated, and generates an M-S mode flag (the flag 504F in FIG. 5) indicating whether or not the M-S mode is to be activated, and the pitch contour reconstructor (the harmonic time-warping reconstruction block 502) reconstructs the pitch contour information (the information 503*ia*) according to the generated decoded pitch parameters (the parameters 502*i*) and the generated M-S mode flag (the flag 504F) output from the first decoder (the lossless decoding block 501).

In this configuration, whether or not the M-S mode is activated is detected, and the user's trouble of operations to indicate whether or not the M-S mode is activated is detected is saved, and thus the operation is simplified.

The blocks refer to what is called functional blocks.

Industrial Applicability

Producing the advantageous effects as described above, the encoding device 1 and the decoding device 2 operate more appropriately.

Therefore, the encoding device 1 and the decoding device 2 contribute to development of industry in the field where they are manufactured and used.

Reference Signs List

1 Encoding device
2 Decoding device
2S System
101 Pitch contour analysis unit
102 Dynamic time-warping unit
103 Lossless coding unit
104 Time-warping unit
105 Transform encoder
106 Multiplexer
201 Lossless decoding unit
202 Dynamic time-warping reconstruction unit
203 Time-warping unit
204 Transform decoder
205 Demultiplexer

The invention claimed is:

1. An encoding device comprising:

a pitch detector which detects pitch contour information of an input audio signal;

a pitch parameter generator which generates, based on the detected pitch contour information, pitch parameters that include pitch change ratios within a range including a range of the pitch change ratios corresponding to absolute pitch differences of 42 cents or larger;

a first encoder which codes the generated pitch parameters;

a pitch shifter which shifts pitch frequency of the input audio signal according to the pitch contour information;

a second encoder which codes audio signal obtained by the shifting and output from said pitch shifter; and a multiplexer which combines the coded pitch parameters output from said first encoder and data of the audio signal output from said pitch shifter and then coded by and output from said second encoder, to generate a bitstream including the coded pitch parameter and the data, wherein said first encoder codes each of the pitch parameters into a coded pitch parameter having a predetermined code length, when the pitch parameter includes a pitch change ratio corresponding to an absolute pitch difference smaller than 42 cents, and codes each of the pitch parameters into a coded pitch parameter having a code length longer than the predetermined code length, when the pitch parameter includes a pitch change ratio corresponding to an absolute difference of 42 cents or larger.

2. The encoding device according to claim 1, wherein said pitch parameter generator generates, based on the detected pitch contour information, the pitch parameters including pitch change positions and the pitch change ratios.

3. The encoding device according to claim 2, further comprising:

a first decoder which generates decoded pitch parameters including decoded pitch change positions and decoded pitch change ratios from the coded pitch parameters output from said first encoder; and a pitch contour reconstructor which reconstructs the pitch contour information according to the generated decoded pitch parameters, wherein said pitch shifter shifts pitch frequency of the input audio signal according to the reconstructed pitch contour information.

4. The encoding device according to claim 2, further comprising:

an M-S mode selector which checks whether or not a middle and side stereo mode (M-S stereo mode) is to be activated for each audio frame of the input stereo audio signals and generates a flag indicating whether or not the M-S stereo mode is to be activated for the audio frame; and a downmixer which downmixes the input stereo audio signals according the generated flag, wherein said pitch detector detects, according to the flag, pitch contour information of a downmixed signal obtained by the downmixing of the input stereo audio signals or pitch contour information of the input stereo audio signals, and said pitch shifter shifts pitch frequency of the input stereo audio signals or pitch frequency of the downmixed signal according to the pitch contour information and the flag.

5. The encoding device according to claim 2, further comprising:

an M-S mode selector which determines, according to the input stereo audio signals, whether or not a middle and side stereo mode (M-S stereo mode) is to be activated and generates a flag indicating whether or not the M-S stereo mode is to be activated;

a downmixer which downmixes the input stereo audio signals according the generated flag;

a first decoder; and a pitch contour reconstructor, wherein said pitch detector detects, according to the flag, pitch contour information of a downmixed signal obtained by the downmixing of the input stereo audio signals or pitch contour information of the input stereo audio signals, said first decoder generates decoded pitch parameters including decoded pitch change positions and decoded pitch change ratios from the coded pitch parameters output from said first encoder, said pitch contour reconstructor reconstructs the pitch contour information according to the generated decoded pitch parameters and the flag; and said pitch shifter shifts pitch frequency of the input stereo audio signals or the downmixed signal according to the reconstructed pitch contour information.

6. The encoding device according to claim 5, further comprising a comparison unit configured to determine whether or not to use said pitch shifter, wherein said multiplexer combines coded pitch parameters output from said comparison unit and coded data to generate the bitstream.

7. The pitch parameter generator included in the encoding device according to claim 1, which modifies the pitch contour information based on a comparison between a first harmonic structure and a second harmonic structure and determines whether or not pitch shifting is to be applied, the first harmonic structure being a structure before the pitch shifting, and the second harmonic structure being a structure after the pitch shifting.

8. A signal processing system comprising the encoding device according to claim 1 and a decoding device, wherein said decoding device decodes a bitstream including coded data of a pitch-shifted audio signal and coded pitch parameter information, and includes:

a demultiplexer which separates the coded data and the coded pitch parameter information from the bitstream to be decoded;

a first decoder which generates, from the separated coded pitch parameters, decoded pitch parameters that include pitch change ratios within a range including a range of the pitch change ratios corresponding to absolute pitch differences of 42 cents or larger;

a pitch contour reconstructor which reconstructs pitch contour information according to the generated decoded pitch parameters;

a second decoder which decodes the separated coded data to generate the pitch-shifted audio signal; and an audio signal reconstructor which transforms the pitch-shifted audio signal into an original audio signal according to the reconstructed pitch contour information, and said first decoder decodes each of the separated coded pitch parameters into a decoded pitch parameter including a pitch change ratio corresponding to an absolute pitch difference smaller than 42 cents, when the separated coded pitch parameter has a predetermined code length, and decodes each of the separated coded pitch parameters into a decoded pitch parameter including a pitch change ratio corresponding to an absolute difference of 42 cents or larger, when the separated coded pitch parameter has a code length longer than the predetermined code length.

9. A decoding device which decodes a bitstream including coded data of a pitch-shifted audio signal and coded pitch parameter information, said decoding device comprising:

a demultiplexer which separates the coded data and the coded pitch parameter information from the bitstream to be decoded;

a first decoder which generates, from the separated coded pitch parameters, decoded pitch parameters that include pitch change ratios within a range including a range of the pitch change ratios corresponding to absolute pitch differences of 42 cents or larger;

a pitch contour reconstructor which reconstructs pitch contour information according to the generated decoded pitch parameters;

a second decoder which decodes the separated coded data to generate the pitch-shifted audio signal; and an audio signal reconstructor which transforms the pitch-shifted audio signal into an original audio signal according to the reconstructed pitch contour information, wherein said first decoder decodes each of the separated coded pitch parameters into a decoded pitch parameter including a pitch change ratio corresponding to an absolute pitch difference smaller than 42 cents, when the separated coded pitch parameter has a predetermined code length, and decodes each of the separated coded pitch parameters into a decoded pitch parameter including a pitch change ratio corresponding to an absolute difference of 42cents or larger, when the separated coded pitch parameter has a code length longer than the predetermined code length.

10. The decoding device according to claim 9, wherein said first decoder generates, from the separated coded pitch parameter information, the decoded pitch parameters including pitch change positions and the pitch change ratios.

11. The decoding device according to claim 10, wherein said decoding device decodes the bitstream including the coded data of a pitch-shifted audio signal, and includes an M-S mode detector, said second decoder decodes the separated coded data to generate the pitch-shifted stereo audio signals and M-S mode coding information, said M-S mode detector detects, according to the M-S mode coding information, whether the M-S mode is activated, and generates an M-S mode flag indicating whether or not the M-S mode is to be activated, and said pitch contour reconstructor reconstructs the pitch contour information according to the generated decoded pitch parameters and the generated M-S mode flag output from said first decoder.

12. A method of coding, comprising:

detecting pitch contour information of an input audio signal;

generating, based on the detected pitch contour information, pitch parameters that include pitch change ratios within a range including a range of the pitch change ratios corresponding to absolute pitch differences of 42 cents or larger;

coding the generated pitch parameters;

shifting pitch frequency of the input audio signal according to the pitch contour information;

coding an audio signal obtained by and output in said shifting; and combining the coded pitch parameters output in said coding of the generated pitch parameters and data of the audio signal output in said shifting and then coded in and output in said coding of an audio signal, to generate a bitstream including the coded pitch parameter and the data, wherein said coding the generated pitch parameters includes coding each of the pitch parameters into a coded pitch parameter having a predetermined code length, when the pitch parameter includes a pitch change ratio corresponding to an absolute pitch difference smaller than 42 cents, and coding each of the pitch parameters into a coded pitch parameter having a code length longer than the predetermined code length, when the pitch parameter includes a pitch change ratio corresponding to an absolute difference of 42 cents or larger.

13. A method of decoding a bitstream including coded data of a pitch-shifted audio signal and coded pitch parameter information, said method comprising:

separating the coded data and the coded pitch parameter information from the bitstream to be decoded;

generating, from the separated coded pitch parameters, decoded pitch parameters that include pitch change ratios within a range including a range of the pitch change ratios corresponding to absolute pitch differences of 42 cents or larger;

reconstructing pitch contour information according to the generated decoded pitch parameters;

decoding the separated coded data to generate the pitch-shifted audio signal; and transforming the pitch-shifted audio signal into an original audio signal according to the reconstructed pitch contour information, wherein said generating includes decoding each of the separated coded pitch parameters into a decoded pitch parameter including a pitch change ratio corresponding to an absolute pitch difference smaller than 42 cents, when the separated coded pitch parameter has a predetermined code length, and decoding each of the separated coded pitch parameters into a decoded pitch parameter including a s itch change ratio cones corresponding to an absolute difference of 42 cents or larger, when the separated coded pitch parameter has a code length longer than the predetermined code length.

14. An integrated circuit, comprising:

a pitch detector which detects pitch contour information of an input audio signal;

a pitch parameter generator which generates, based on the detected pitch contour information, pitch parameters that include pitch change ratios within a range including a range of the pitch change ratios corresponding to absolute pitch differences of 42 cents or larger;

a first encoder which codes the generated pitch parameters;

a pitch shifter which shifts pitch frequency of the input audio signal according to the pitch contour information;

a second encoder which codes audio signal obtained by the shifting and output from said pitch shifter; and a multiplexer which combines the coded pitch parameters output from said first encoder and data of the audio signal output from said pitch shifter and then coded by and output from said second encoder, to generate a bitstream including the coded pitch parameter and the data, wherein said first encoder codes each of the pitch parameters into a coded pitch parameter having a predetermined code length, when the pitch parameter includes a pitch change ratio corresponding to an absolute pitch difference smaller than 42 cents, and codes each of the pitch parameters into a coded pitch parameter having a code length longer than the predetermined code length, when the pitch parameter includes a pitch change ratio corresponding to an absolute difference of 42 cents or larger.

15. An integrated circuit which decodes a bitstream including coded data of a pitch-shifted audio signal and coded pitch parameter information, said integrated circuit comprising:

a demultiplexer which separates the coded data and the coded pitch parameter information from the bitstream to be decoded;

a first decoder which generates, from the separated coded pitch parameters, decoded pitch parameters that include pitch change ratios within a range including a range of the pitch change ratios corresponding to absolute pitch differences of 42 cents or larger;

a pitch contour reconstructor which reconstructs pitch contour information according to the generated decoded pitch parameters;

a second decoder which decodes the separated coded data to generate the pitch-shifted audio signal; and an audio signal reconstructor which transforms the pitch-shifted audio signal into an original audio signal according to the reconstructed pitch contour information, wherein said first decoder decodes each of the separated coded pitch parameters into a decoded pitch parameter including a pitch change ratio corresponding to an absolute pitch difference smaller than 42 cents, when the separated coded pitch parameter has a predetermined code length, and decodes each of the separated coded pitch parameters into a decoded pitch parameter including a pitch change ratio corresponding to an absolute difference of 42 cents or larger, when the separated coded pitch parameter has a code length longer than the predetermined code length.

16. A non-transitory computer-readable recording medium having a program thereon, the program causing a computer to execute:

detecting pitch contour information of an input audio signal;

generating, based on the detected pitch contour information, pitch parameters that include pitch change ratios within a range including a range of the pitch change ratios corresponding to absolute pitch differences of 42 cents or larger;

coding the generated pitch parameters;

shifting pitch frequency of the input audio signal according to the pitch contour information;

coding an audio signal obtained by and output in said shifting; and combining the coded pitch parameters output in said coding of the generated pitch parameters and data of the audio signal output in said shifting and then coded in and output in said coding of an audio signal, to generate a bitstream including the coded pitch parameter and the data, wherein said coding the generated pitch parameters includes coding each of the pitch parameters into a coded pitch parameter having a predetermined code length when the pitch parameter includes a pitch change ratio corresponding to an absolute pitch difference smaller than 42 cents, and coding each of the pitch parameters into a coded pitch parameter having a code length longer than the predetermined code length, when the pitch parameter includes a pitch change ratio corresponding to an absolute difference of 42 cents or larger.

17. A non-transitory computer-readable recording medium having a program thereon for causing a computer to decode a bitstream including coded data of a pitch-shifted audio signal and coded pitch parameter information, the program causing the computer to execute:

separating the coded data and the coded pitch parameter information from the bitstream to be decoded;

generating, from the separated coded pitch parameters, decoded pitch parameters that include pitch change ratios within a range including a range of the pitch change ratios corresponding to absolute pitch differences of 42 cents or larger;

reconstructing pitch contour information according to the generated decoded pitch parameters;

decoding the separated coded data to generate the pitch-shifted audio signal; and transforming the pitch-shifted audio signal into an original audio signal according to the reconstructed pitch contour information, wherein said generating includes decoding each of the separated coded pitch parameters into a decoded pitch parameter including a pitch change ratio corresponding to an absolute pitch difference smaller than 42 cents, when the separated coded pitch parameter has a predetermined code length, and decoding each of the separated coded pitch parameters into a decoded pitch parameter including a pitch change ratio corresponding to an absolute difference of 42 cents or larger, when the separated coded pitch parameter has a code length longer than the predetermined code length.

* * * * *